US011987924B2

(12) United States Patent
Kim et al.

(10) Patent No.: US 11,987,924 B2
(45) Date of Patent: May 21, 2024

(54) LAUNDRY TREATING APPARATUS

(71) Applicant: LG Electronics Inc., Seoul (KR)

(72) Inventors: Jaehyung Kim, Seoul (KR); Semin Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/477,777

(22) Filed: Sep. 17, 2021

(65) Prior Publication Data

US 2022/0002934 A1 Jan. 6, 2022

Related U.S. Application Data

(63) Continuation of application No. 16/427,705, filed on May 31, 2019, now Pat. No. 11,168,438.

(30) Foreign Application Priority Data

Jun. 1, 2018 (KR) ..... 10-2018-0063623
Jun. 28, 2018 (KR) ..... 10-2018-0074728

(51) Int. Cl.
*D06F 73/02* (2006.01)
*D06F 58/10* (2006.01)
(Continued)

(52) U.S. Cl.
CPC ..... *D06F 73/02* (2013.01); *D06F 58/10* (2013.01); *D06F 67/005* (2013.01); *D06F 58/203* (2013.01)

(58) Field of Classification Search
CPC ..... D06F 73/02; D06F 58/10; D06F 58/203; D06F 58/14; D06F 58/26; D06F 67/005; D06F 63/00; D06F 65/02
See application file for complete search history.

(56) References Cited

U.S. PATENT DOCUMENTS 2,119,222 A * 5/1938 Carson ..... D06F 65/04 38/67
2,202,167 A * 5/1940 Peters ..... D06F 67/005 312/317.2
(Continued)

FOREIGN PATENT DOCUMENTS

CN 103911801 A 7/2014
CN 104294529 A 1/2015
(Continued)

OTHER PUBLICATIONS

European Search Report in European Application No. 19177682.2 from the European Patent Office (EPO) dated Aug. 27, 2019.
(Continued)

*Primary Examiner* — Ismael Izaguirre
(74) *Attorney, Agent, or Firm* — Birch, Stewart, Kolasch & Birch, LLP

(57) ABSTRACT

The embodiments of the present disclosure provide a laundry treating apparatus comprising a cabinet comprising an accommodation space configured to hold clothes therein, a support body disposed in the accommodation space and configured to define a predetermined space in which the clothes are supported, a compression body rotatably secured to the support body and configured to rotate in a direction towards the support body and a direction away from the support body, the compression body being configured to press the clothes towards the support body, a moisture chamber disposed in at least one of the compression body or the support body, and a moisture supply unit configured to supply steam or moisture to the moisture chamber.

13 Claims, 17 Drawing Sheets

(51) Int. Cl.
*D06F 67/00* (2006.01)
*D06F 58/20* (2006.01)

(56) References Cited

U.S. PATENT DOCUMENTS

| | | | | | |
|---|---|---|---|---|---|
| 2,331,789 | A * | 10/1943 | Davida | D06F 67/005 38/56 |
| 2,478,531 | A * | 8/1949 | Harris | D06F 67/005 312/28 |
| 3,117,704 | A | 1/1964 | McMillan | |
| 3,145,490 | A | 8/1964 | Corby | |
| 3,203,122 | A | 8/1965 | Sweatt | |
| 3,491,469 | A | 1/1970 | Niehenke | |
| 4,611,419 | A | 9/1986 | Duplessy et al. | |
| 4,682,429 | A | 7/1987 | Okkerse | |
| 4,694,146 | A | 9/1987 | DeMars | |
| 4,980,981 | A | 1/1991 | Naidoo | |
| 5,359,792 | A | 11/1994 | Hanada et al. | |
| 5,711,097 | A | 1/1998 | Minó | |
| 7,032,336 | B2 | 4/2006 | Bedretdinov | |
| 9,309,618 | B2 * | 4/2016 | Park | D06F 58/10 |
| 2015/0020419 | A1 | 1/2015 | Park et al. | |
| 2018/0135237 | A1 | 5/2018 | Yoon et al. | |

FOREIGN PATENT DOCUMENTS

| | | | | |
|---|---|---|---|---|
| CN | 104903507 | A | 9/2015 | |
| CN | 104919105 | A | 9/2015 | |
| EP | 0816522 | A2 | 1/1998 | |
| EP | 2 826 911 | B8 | 3/2016 | |
| EP | 2 889 426 | B1 | 5/2017 | |
| EP | 3 321 413 | B1 | 10/2019 | |
| JP | 58-65200 | A | 4/1983 | |
| JP | 2002-166098 | A | 6/2002 | |
| KR | 10-2001-0113436 | A | 12/2001 | |
| KR | 10-2012-0091799 | A | 8/2012 | |
| KR | 10-2015-0009718 | A | 1/2015 | |
| WO | WO-9849384 | A2 * | 11/1998 | D06F 65/02 |

OTHER PUBLICATIONS

Chinese Office Action in Chinese Application No. 201910468881.2, dated Jul. 22, 2021 (20 pages).

* cited by examiner

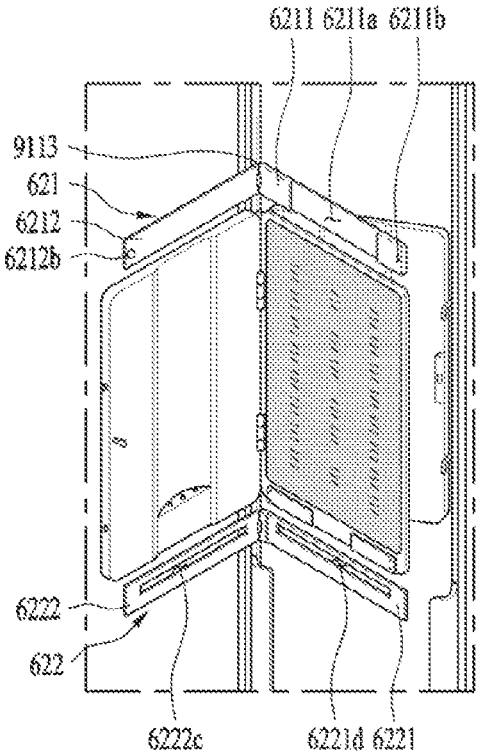
FIG. 17A
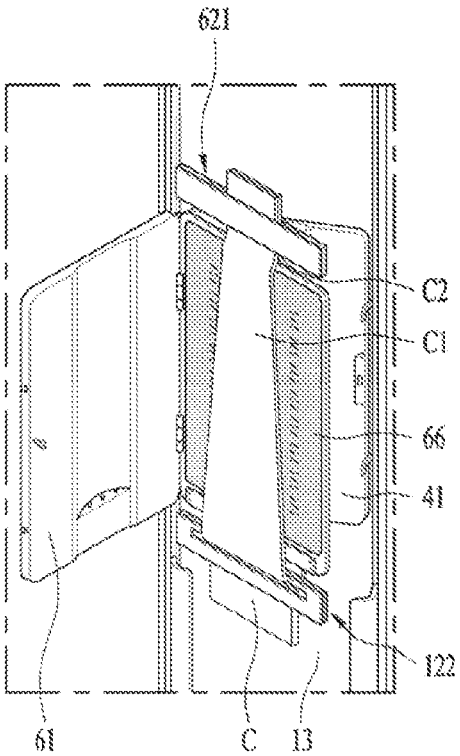
FIG. 17B
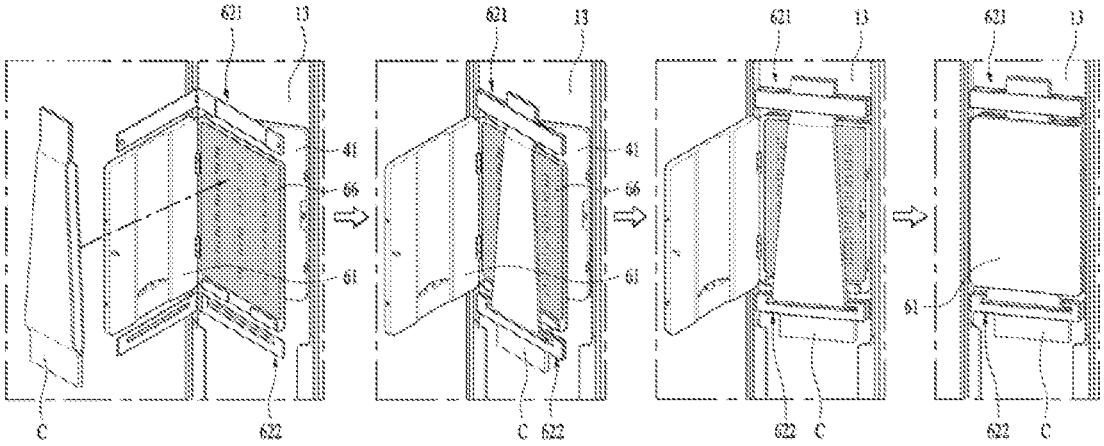
FIG. 18A
FIG. 18B
FIG. 18C
FIG. 18D

LAUNDRY TREATING APPARATUS

CROSS-REFERENCE TO RELATED APPLICATIONS

This application is a continuation of U.S. patent application Ser. No. 16/427,705, filed on May 31, 2019, which claims priority under 35 U.S.C. § 119 to Korean Patent Application No. 10-2018-0063623, filed on Jun. 1, 2018, and Korean Patent Application No. 10-2018-0074728, filed on Jun. 28, 2018, the disclosures of all of which are hereby incorporated by reference in their entireties.

BACKGROUND OF THE DISCLOSURE

Field of the Disclosure

Embodiments of the present disclosure relate to a laundry treating apparatus.

Background of the Disclosure

In general, a laundry treating apparatus is a home appliance configured to perform diverse treating processes that are related to clothes (e.g., washing, drying, deodorizing, wrinkle-removing and the like). The laundry treating apparatus may comprise a washing machine for washing clothes, a dryer for drying wet clothes, and a refresher for deodorizing bad smell pervaded in clothes or removing wrinkles of clothes.

Conventional laundry treating apparatuses use a drum to hold clothes and a drive mechanism to rotate the drum. Thus, conventional laundry treating apparatuses are unsatisfactory in deodorizing the bad smell or removing the winkles. In other words, it is typical for conventional laundry treating apparatuses to perform deodorizing or winkle-removing while the drum is rotating. Because the clothes loaded in the drum are wrinkled, rather than being ironed straight, deodorizing or wrinkle-removing is restricted.

Moreover, conventional laundry treating apparatuses have no means for putting a pleat or creasing in clothes (a preset wrinkle). Accordingly, to put such a creasing in clothes, a user has to use other means for putting the creasing, such as an ironing after washing or drying.

SUMMARY OF THE DISCLOSURE

Accordingly, an object of the present disclosure is to address the above-noted and other problems and provide a laundry treating apparatus configured to facilitate drying, deodorizing, and wrinkle-removing.

Another object of the present disclosure is to provide a laundry treating apparatus which includes a presser configured to put a pleat included in a design of the clothes and remove a wrinkle not included in the design.

A further object of the present disclosure is to provide a laundry treating apparatus configured to uniformly press each of the divided areas, when there are divided areas of clothes such as a piece of trousers.

A further object of the present disclosure is to provide a laundry treating apparatus configured to uniformly supply at least one of the steam or hot air to each of the divided areas of the clothes.

A further object of the present disclosure is to provide a laundry treating apparatus configured to press plural pieces of clothes at one go.

A further object of the present disclosure is to provide a laundry treating apparatus configured to prevent the position of the clothes from being changed while they are pressed.

A further object of the present disclosure is to provide a laundry treating apparatus configured to form a crease in an intended area precisely.

Embodiments of the present disclosure may provide a laundry treating apparatus comprising a cabinet, the cabinet comprising an accommodation space configured to hold clothes therein; a support body provided in the accommodation space and configured to define a predetermined space in which the clothes are supported; a compression body rotatably secured to the accommodation space and rotatable in a direction towards the support body and a direction getting farther from the support body, the compression body configured to press the clothes towards the support body; a moisture chamber provided in at least one of the compression body or the support body; and a moisture supply unit configured to supply steam or moisture to the moisture chamber.

The moisture chamber may be provided in the compression body along a height direction of the accommodation space, and the moisture supply unit may be provided in the compression body.

The compression unit may comprise a mounding portion configured to detachably accommodate the moisture supply unit; and a power supply unit disposed in the mounting portion and connected with an electric power, and the moisture supply unit may comprise a storage body detachably disposed in the mounting portion and configured to define a space for storing water; a heater disposed in the storage body; a connection terminal fixed to the outside of the storage body and configured to connect the power supply unit to the heater; and an discharge unit configured to discharge steam or moisture from the storage body to the moisture chamber.

The compression body may comprise a mounting portion configured to detachably accommodate the moisture supply unit; and a power supply unit disposed in the mounting portion, and the moisture supply unit may comprise a storage body detachably disposed in the mounting portion and configured to define a space for storing water; an oscillator configured to generate steam by vibrating the water stored in the storage body; a connection terminal fixed to the outside of the storage body and configured to connect the power supply unit to the heater; and an discharge unit configured to discharge steam or moisture from the storage body to the moisture chamber.

The compression body may comprise a first body disposed in a left area of the moisture chamber along a height direction of the accommodation space and configured to press the clothes to the support body; and a second body disposed in a right area of the moisture chamber along the height direction of the accommodation space and configured to press the clothes to the support body.

The support body may comprise a support body groove disposed along the height direction of the accommodation space and configured to define a predetermined space for accommodating a sewing line of the clothes, corresponding to the moisture chamber; a first support surface disposed in an area of the support body groove and configured to support the clothes pressed by the first body; and a second support surface disposed in another area of the support body groove and configured to support the clothes pressed by the second body.

The laundry treating apparatus may further comprise a heat plate disposed in one surface of the compression body towards the support body and formed of a conductive material; and a heat source disposed between the heat plate and the compression body and configured to supply heat to the heat plate.

The laundry treating apparatus may further comprise a first heat plate fixed to the first body and formed of a conductive material; a second heat plate fixed to the second body and formed of a conductive material; a first heat source provided between the first heat plate and the first body and configured to supply heat to the first heat plate; and a second heat source provided between the second heat plate and the second body and configured to supply heat to the second heat plate.

At least predetermined area of the support body may be formed of a conductive material and a heat source for heating the conductive material may further be provided.

The support body may be provided as one of the surfaces defining the accommodation space or secured to one of the surfaces, and the compression body may be rotatably coupled to the support body or the surface having the support body secured thereto.

The laundry treating apparatus may further comprise an opening penetrating a front surface of the cabinet and configured to allow the accommodation space to communicate with the accommodation space; and a door rotatably coupled to the cabinet and configured to open and close the opening, wherein the support body is fixed to the door and the compression body is rotatably coupled to the support body or the door.

The laundry treating apparatus may further comprise a first clothes—support unit configured to secure the clothes to the door to locate the clothes in a surface of the support body; a second clothes-support unit provided in the accommodation space and configured to dispose the clothes in the accommodation space; an accommodation space air supply unit configured to supply heated-air to the accommodation space; and an accommodation space moisture supply unit configured to supply steam or moisture to the accommodation space.

In another aspect of the present disclosure, a laundry treating apparatus may comprise a cabinet, the cabinet comprising an accommodation space configured to hold clothes therein; an accommodation moisture supply unit configured to supply moisture to the accommodation space; a support body disposed in the accommodation space and configured to define a predetermined space in which the clothes are supported; a compression body rotatably secured to the accommodation space and rotatable in a direction towards the support body and a direction getting farther from the support body, the compression body configured to press the clothes towards the support body; a body through hole penetrating the compression body and configured to supply moisture to the support body; and a first heating unit disposed in at least one of the compression body and the support body and configured to supply heat to the clothes.

The first heating unit may comprise a heat plate disposed in one surface of the compression body towards the support body and formed of a conductive material; and a heat plate through hole provided through the heat plate and configured to communicate with the body through hole; and a heat source disposed between the heat plate and the compression body and configured to supply heat to the heat plate.

The compression body may comprise a compression body groove configured to provide a space for accommodating a sewing line of the clothes; a first body disposed in a left area of the compression body groove along a height of the accommodation space and configured to press the clothes to the support body; and a second body disposed in a right area of the moisture chamber along the height direction of the accommodation space and configured to press the clothes to the support body.

The laundry treating apparatus may further comprise a first heat plate fixed to the first body and formed of a conductive material; a second heat plate fixed to the second body and formed of a conductive material; a first heat source disposed between the first heat plate and the first body and configured to supply heat to the first heat plate; and a second heat source disposed between the second heat plate and the second body and configured to supply heat to the second heat plate.

At least a predetermined area of the support body may be formed of a conductive material and a heat source for heating the conductive material may further be provided.

According to embodiments of the present disclosure, the laundry treating apparatus may be configured to facilitate drying, deodorizing, and wrinkle-removing.

Furthermore, the laundry treating apparatus may include the presser configured to put a pleat included in a design of clothes and remove a wrinkle not included in the design.

Still further, the laundry treating apparatus may be configured to uniformly press each of the divided areas, when there are divided areas of clothes such as a piece of trousers.

Still further, the laundry treating apparatus may be configured to uniformly supply at least one of the steam, moisture, or hot air to each of the divided areas of the clothes.

Still further, the laundry treating apparatus may be configured to press plural pieces of clothes at once.

Still further, the laundry treating apparatus may be configured to prevent the position of the clothes from being changed while the clothes are pressed.

Still further, the laundry treating apparatus may be configured to form a crease in an intended area.

Further scope of applicability of the present disclosure will become apparent from the detailed description given hereinafter. However, it should be understood that the detailed description and specific examples, while indicating preferred embodiments of the disclosure, are given by illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings, which are given by illustration only, and thus are not limitative of the present disclosure, and wherein:

FIGS. 17A-B are diagrams illustrating an exemplary structure of a clamp for handing clothes on the pressure of the laundry treating apparatus, in accordance with the present disclosure; and FIGS. 18A-D are diagrams illustrating an exemplary structure of the presser where the exemplary structure is configured to allow clothes to be placed on the clamp, in accordance with the present disclosure.

DESCRIPTION OF SPECIFIC EMBODIMENTS

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. A singular representation may include a plural representation unless it represents a definitely different meaning from the context. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

Figure 1:
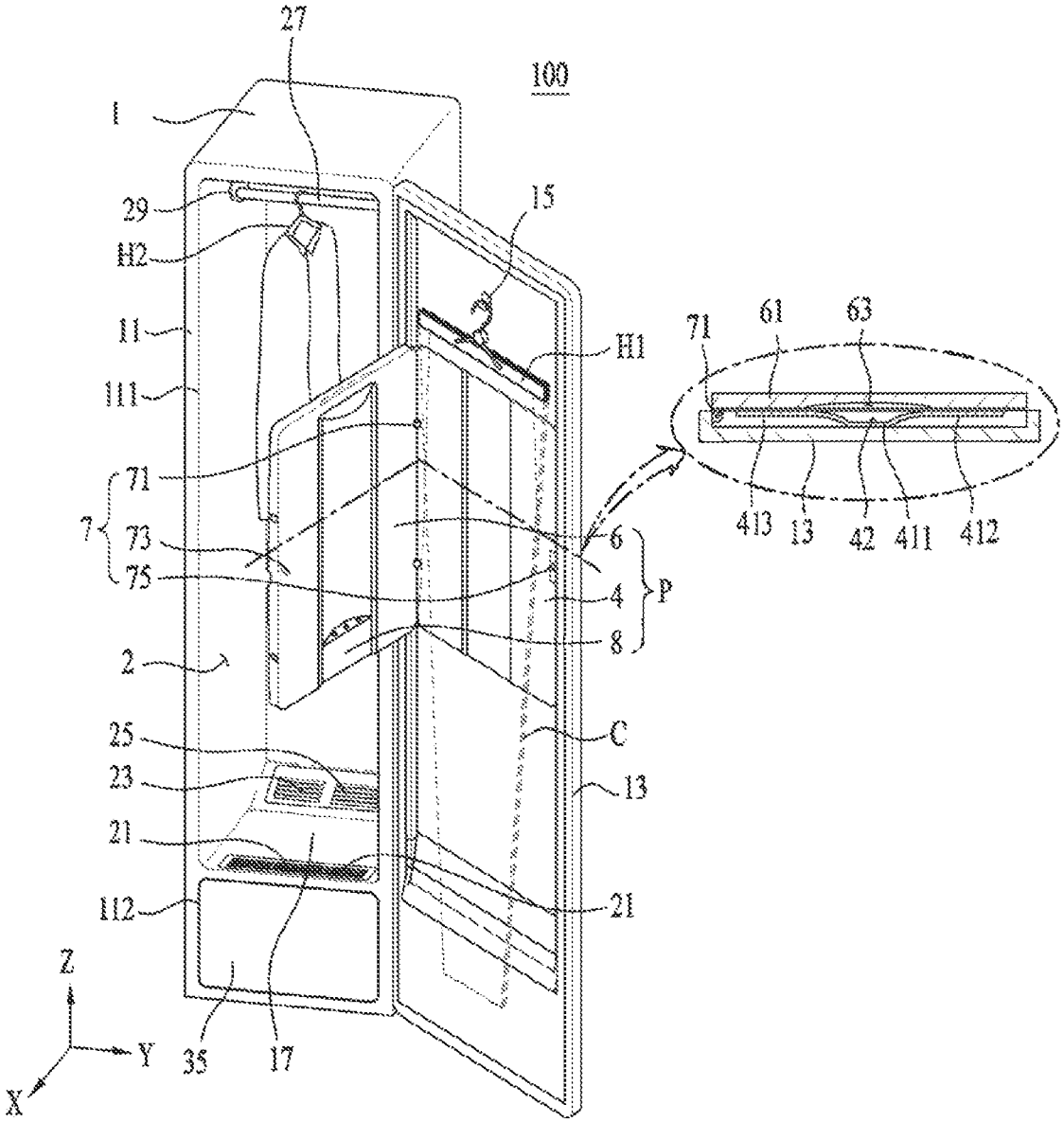
FIG. 1 is a diagram illustrating an exemplary embodiment of a laundry treating apparatus, in accordance with the present disclosure.
Figure 2:
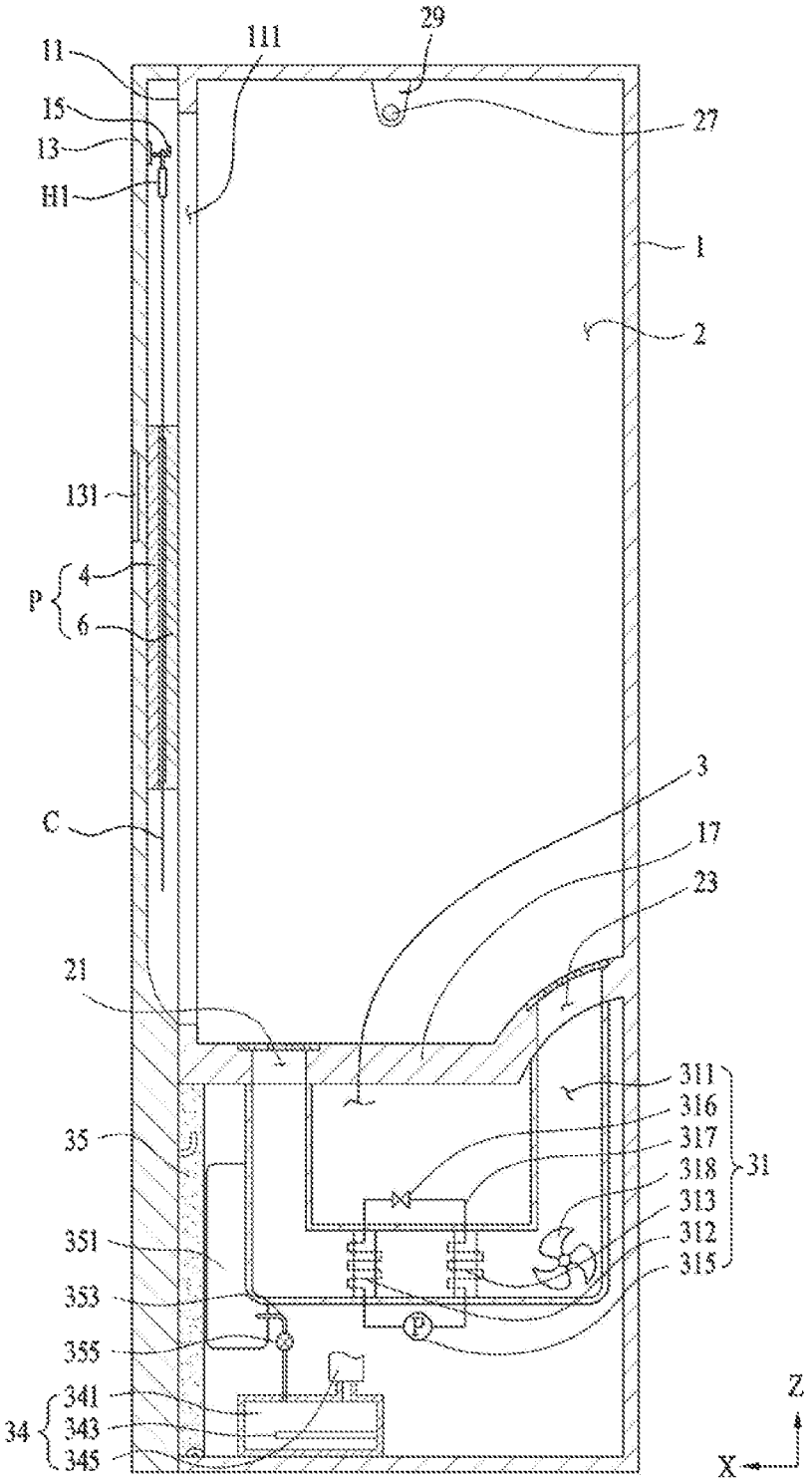
FIG. 2 is a diagram illustrating another exemplary embodiment of the laundry treating apparatus of FIG. 1, in accordance with the present disclosure.

As shown in FIGS. 1 and 2, a laundry treating apparatus 100 in accordance with the embodiments of the present disclosure may include a cabinet 1 that defines the exterior design of the laundry treating apparatus 100; an inner case 2, such as an accommodation space, disposed in the cabinet 1 and defining a predetermined space for holding clothes; a supply unit, such as air supply unit 31 and moisture supply unit 34 in FIG. 2, configured to supply at least one of the air, steam, or moisture to the inner case 2; and a presser P provided in the inner case 2 and configured to strengthen a pleat or creasing included in in a design of clothes while pressing a wrinkle not included in the design.

The supply units may be disposed in the machine room 3, and the machine room 3 may have a predetermined space that is partitioned off from the inner case 2. FIG. 2 illustrates that the machine room 3 may be partitioned off by a partition wall 17 to locate the machine room 3 under the inner case.

As shown in FIG. 1, a door 13 may be rotatably coupled to the cabinet 1 with respect to a shaft provided along a height direction of the cabinet (a Z-axis direction) in a direction away from a front surface 11 of the cabinet and towards the front surface 11. The inner case 2 may be in communication with the outside via an opening 111 provided in the front surface 11, and the machine room 3 may be in communication with the outside via a communication opening 112 provided in the front surface 11.

The communication opening 112 may be open and closed by a machine room door 35 detachably coupled to the cabinet 1. When the door 13 is rotated towards the direction away from the front surface 11, the opening 111 and the machine room door 35 may be exposed to the outside at the same time.

A hanger or first clothes-support unit 15 may be configured to support clothes in the door 13, and a hanger or second clothes-support unit may be provided in the inner case 2.

FIG. 1 illustrates one embodiment of a laundry treating apparatus 100, wherein the first clothes-support unit 15 is provided as a protrusion formed in one surface (e.g., an inner surface) of the door forming the inner case 2. In some embodiments, the first clothes-support unit 15 may be configured to support a hanger H1.

The second clothes-support unit may include a support bar 27 disposed along a width direction (Y-axis direction) of the inner case 2 or a depth direction (X-axis direction) of the inner case 2, and a support bar fixing portion 29 configured to fix both ends of the support bar 27 to an upper surface of the inner case 2. The support bar 27 may be configured to support a hook of the hanger H2. The clothes hung on the hanger H1 and H2 may be kept spaced apart by the first and second clothes-support units 27 and 29.

The supply unit may comprise an air supply unit 31 configured to supply heated-air or not-heated air to the inner case 2, or a moisture supply unit 34 configured to supply steam or moisture to the inner case 2.

The air supply unit 31 may include a duct configured to discharge air from the inner case 2 to the outside and then guide the air to the inner case 2 again. The air supply unit 31 may also include a heat change unit configured to exchange heat with the air flowing along the duct.

The inner case 2 and the machine room 3 may be configured to communicate with each other via an outlet hole 21 and an inlet hole 23 that penetrate the partition wall 17. One end of the duct 311 may be connected with the outlet hole 21 and the other end may be connected with the inlet hole 23. In some embodiments, the duct 311 may be provided in the machine room 3.

The heat exchange unit may include a fan 318 rotatable in the duct 311, and a heat pump configured to dehydrate and heat the air drawn into the duct 311.

The heat exchange unit comprising a heat pump may include a refrigerant pipe 317 configured to provide a circulation path of a refrigerant, a first heat exchanger 312, such as an evaporator, disposed between the outlet hole 21 and the fan 318, a second heat exchanger 313, such as a condenser, fixed to the refrigerant pipe 317 between the first heat exchanger 312 and the fan 318, a compressor 315 configured to circulate the refrigerant along the refrigerant pipe 317, and a an expander 316 configured to lower the pressure of the refrigerant having passed the second heat exchanger 313.

The first and second heat exchanger 312 and 313 may be disposed in the duct 311. The compressor 315 and the expander 316 may be disposed outside the duct 311. In this instance, the compressor 315 and the expander 316 may be disposed in an open area that is exposed when the machine room door 35 opens the communication opening 112.

The first heat exchanger 312 may be configured to absorb heat from the duct 311 and transfer the absorbed heat to the refrigerant passing through the refrigerant pipe 317. The refrigerant may be evaporated while passing through the first heat exchanger 313 and condensed (or dehydrated) while passing through the first heat exchanger 312.

The second heat exchanger 313 may be configured to allow the refrigerant discharged from the compressor 315 to transmit the air having passed the first heat exchanger 312 to air. The refrigerant may be condensed while passing through the second heat exchanger 313 and the air may be heated while passing through the second heat exchanger 313.

FIG. 2 illustrates an exemplary embodiment of a moisture supply unit 34 disposed in the machine room 3 and configured to supply steam to the inner case 2. As seen in FIG. 2, the moisture supply unit 34 may include a storage tank 341 disposed in the machine room 3, a tank heater 343 disposed in the storage tank 341, and a supply pipe 345 configured to connect the storage tank 341 to the inner case 2.

The storage tank 341 may be configured to store water and the tank heater 343 may be configured to convert water into vapors by heating the water stored in the storage tank 341. The supply pipe 345 may be configured to guide the steam from the storage tank 341 into the inner case 2. One end of the supply pipe 345 may be fixed to the storage tank 341 and the other end may be connected with the moisture supply hole 25, as illustrated in FIG. 1.

The water from a supply tank 351 fixed to the machine room door 35 may be supplied to the storage tank 341. The supply tank 351 may be connected with the storage tank 341 via the connection pipe 358, and the connection pipe 353 may be open and closed by the valve 255.

When the valve is open without a pump, the supply tank 351 may be disposed in a higher position than the storage tank 341 to allow the water stored in the water supply tank 351 to flow towards the storage tank 341.

In some embodiments, the moisture supply unit 34 may be configured to supply moisture that is not heated. For example, the moisture supply unit 34 may include a storage tank configured to store water, an oscillator configured to generate moisture by vibrating the water stored in storage tank; and a supply pipe configured to guide the vapor stored in the moisture supply unit 34.

A control panel 131 may be disposed on the door 13. On the control panel 131 may be displayed an input configured to input a control command that is needed to operate the accommodation space air supply unit 31 and the accommodation space moisture supply unit 24 and the like.

The laundry treating apparatus 100 may be configured to keep clothes spaced apart in the inner case 2 while moisture, steam, and heated-air (hot air) is supplied to the inner case 2 via the moisture supply unit 34 and the air supply unit 31. Accordingly, the laundry treating apparatus in accordance with the present disclosure may be capable of keeping the clothes in a state of being spread straight in the inner case 2 while the moisture, steam, or hot air are supplied, thereby preventing the wrinkles of the clothes, compared to conventional laundry treating apparatuses which may be configured to supply hot air or steam to the rotating drum to perform the deodorizing and wrinkle-removing.

Meanwhile, the presser P may be disposed in any areas of the inner case 2. In other words, the presser P may be disposed in one of the surfaces that defines the inner case 2. FIG. 2, for example, illustrates that the presser P may be provided in an inner surface of the door 13 (one surface of the inner case). While FIG. 2 illustrates that one presser P may be provided, two or more pressers may be provided in the laundry treating apparatus 100 in accordance with the present disclosure.

As shown in FIG. 1, the presser P may include a support unit 4 disposed in one of the surfaces that defines the inner case 2 and configured to provide a predetermined space that support clothes, and a compression unit 6 configured to press the clothes supported by the support unit 4.

The support unit 4 may be provided as one of the surfaces that define the inner case 2 or one support body fixed to one of the surfaces. In some embodiments, the compression unit 6 may be rotatably coupled to the support body or one surface to which the support body is fixed. FIG. 1 illustrates that the support unit 4 may be provided as a support body 41 fixed to an inner surface of the door 13. The compression unit 6 may be rotatably coupled to the support body 41 or the inner surface of the door 13.

The support body 41 may be formed of a rectangular board of which the width (or Y-axis direction) is shorter than the height (a Z-axis direction). The support body 41 may include a fixing portion 411 fixed to the door 14, and first and second support surfaces 412 and 413 that are extended from right and left sides of the fixing unit 411, respectively.

Different from the fixing unit 411, a free end of the first support surface 412 and a free end of the second support surface 413 may be provided to keep a preset distance from the inner surface of the door 13. When the free ends of the first and second support surfaces 412 and 413 are spaced a preset distance apart from the inner surface of the door 13, the clothes may be compressed more effectively. Each of the support surfaces 412 and 413 may comprise a plate-spring configured to press the clothes towards the support unit.

A support body groove 42 may be further disposed in the support body 41 and configured to provide a predetermined space for accommodating a sewing line formed in the clothes. The support body groove 42 may be recessed from one surface of the fixing unit 411. The distance from the inner surface of the door 13 to the support surfaces 412 and 413 may be set longer than the distance to the surface of the fixing part 411 such that the groove may be provided as the space formed between the two support surfaces 412 and 413.

The compression unit 6 may include a compression body 61 rotatably coupled to the support body 41 or the inner surface of the door by using a coupling unit 71, 73 and 75. FIG. 1, for example, illustrates that the compression body 61 may be coupled to the inner surface of the door 3.

The coupling unit may include a hinge 71 configured to couple the compression body 61 to the inner circumferential surface of the door 13. The hinge 71 may be configured to provide a rotation shaft that is in parallel to the height direction (a height direction or Z-axis direction of the inner case). Accordingly, the compression body 61 may be rotatable in a direction where the support body 41 is located and a direction away from the support body 41 by using the hinge 71.

The coupling unit may further include a coupling projection 73 disposed in the compression body 61, and a coupling groove 75 configured to detachably receive the coupling projection 73.

A moisture chamber 63 may be disposed in one surface of the compression body 61 towards the support body 41. The moisture chamber 4 may comprise a space in which the moisture supplied from the moisture supply unit 8 may be stored. The moisture chamber 63 may comprise a groove that is concavely recessed towards a direction away from the support body from one surface of the compression body 61 that is directed towards the support body.

To maximize the amount of the moisture supplied to the clothes located between the support body 41 and the compression body 61, the moisture chamber 61 may be provided along the height direction of the compression body 61 (e.g., the height direction or Z-axis direction of the inner case 2).

The moisture chamber 63 may be provided in a corresponding position to the support body groove 42. For example, the moisture chamber 63 may be provided in the position forming an upper surface of the groove 42, when the compression body 61 is rotated towards the support body 41. When the moisture chamber 63 is provided corresponding to the support body groove 42, the moisture chamber 63 may also serve as the space that accommodates the sewing line of the clothes formed in the clothes.

Figure 3:
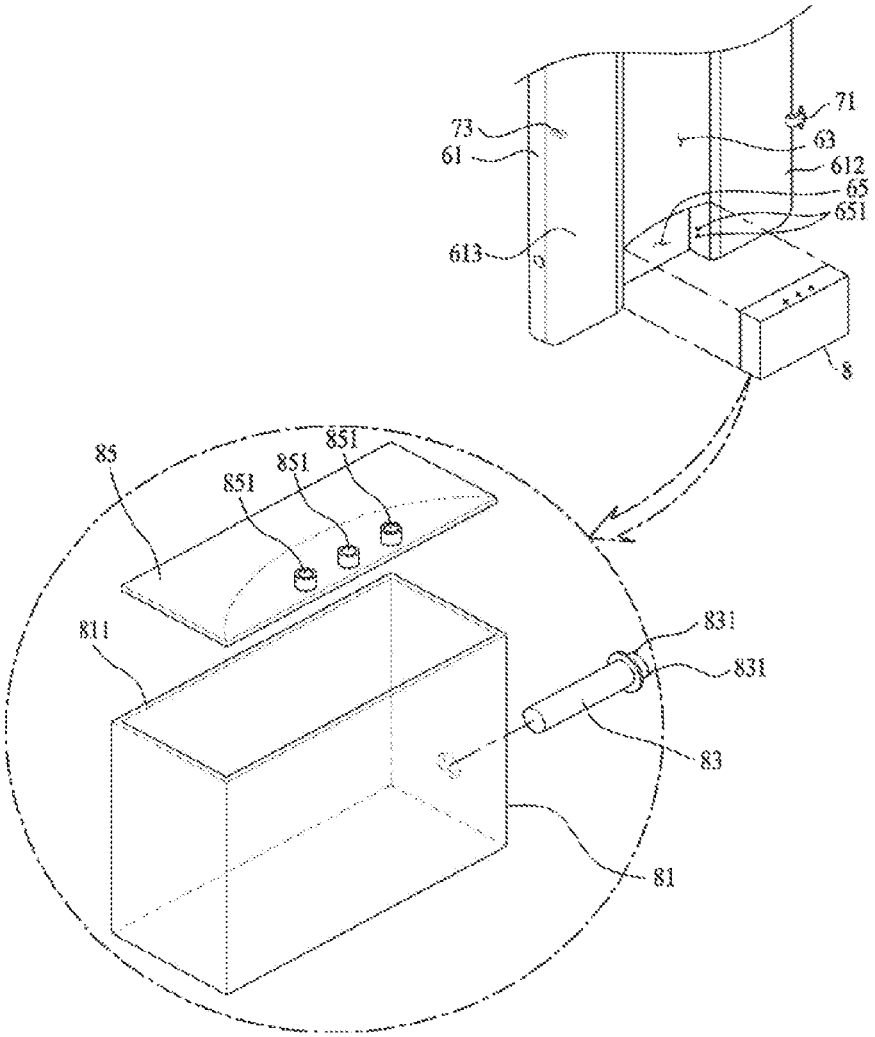
FIG. 3 is a diagram illustrating an exemplary embodiment of a moisture supply unit provided in the laundry treating apparatus, in accordance with the present disclosure.

As shown in FIG. 3, the compression body 61 may be divided into a first body 612 and a second body 613 that are located on respective sides of the moisture chamber 63. The first body 612 may be the area that is configured to press the first support surface 412 of the support body and the second body 613 may be the area that is configured to press the second support surface 413 of the support body.

The moisture supply unit 8 may be disposed in the compression body 61 or the support body 41 and may be configured to supply heated-vapors (or steam) or not-heated vapors (or mist) to the moisture chamber 8. FIG. 3 illustrates that the moisture supply unit 8 may be detachably disposed in the compression body 61.

In some embodiments, the compression body 61 may include a mounting portion 65 disposed between the first and second bodies 612 and 613 and configured to detachably accommodate the moisture supply unit 8, and a power supply unit 615 disposed in the mounting portion 65 and connected with a power source.

The moisture supply unit 8 may include a storage body 81 detachably coupled to the mounting portion 65 and configured to define a predetermined space for storing water, a heater 83 disposed in the storage body and configured to heat the water, a connection terminal 831 configured to connect the heater 83 to the power supply unit 651 when the storage body 81 is inserted in the mounting portion 65, and a discharge unit 851 configured to discharge steam to the moisture chamber 63 from the storage body 81. The connection terminal 831 may be exposed outside the storage body 81 to electrically connect the heater 83 and the power supply unit 651 with each other.

The storage body 81 may comprise a six-sided shape having an open top side and may include a storage body through hole 811 formed in one surface to insert the heater 83 therein. The open side of the storage body 81 may be closed by a cover 85 and the cover may be detachably disposed in the storage body 81 to facilitate the water supply to the storage body 81 or the washing of the storage body 81.

The discharge unit 851 may comprise a plurality of discharge pipes that penetrate the cover 85. Each of the discharge pipes 851 may need to be located in the moisture chamber 63 when the storage body 81 and the cover 85 are mounted to the mounting portion 65.

When the moisture supply unit 8 supplies mist to the moisture chamber 63, the moisture supply unit 8 may include a storage body detachably disposed in the mounting portion 65 to store water, an oscillator configured to generate moisture by vibrating the water stored in storage body, a connection terminal configured to connect the oscillator to the power supply unit when the storage body is insertedly mounted in the mounting portion 65, and a discharge unit configured to discharge steam from the storage body to the moisture chamber 63.

The operation process of the laundry treating apparatus 100 having the above-noted structure will be described as follows.

As shown in FIG. 1, when a user puts a hanger H1 having clothes hung thereon on the first clothes-support unit 15 after rotating the compression body 61 in the direction away from the support body 41, the clothes may be located on the surface of the support body 41.

Hence, the user may rotate the compression body 61 to the position of the support body 41 until the coupling projection 73 is coupled to the coupling groove 75 such that the compression body 61 may be secured to the inner circumferential surface of the door 13. Once the compression body 61 is secured to the inner circumferential surface of the door 13, the clothes may be pressed between the compression body and the support body 41.

In some embodiments, the user may locate the sewing line of the clothes in the groove 42 to prevent the sewing line from causing wrinkles in the clothes. Also, in some embodiments, the user may adjust the location of the clothes not to crumble the designed wrinkles of the clothes.

When a control unit (not shown) is implemented to actuate the moisture supply unit 8 in that state, steam or mist may be supplied to the moisture chamber 63 and most of the steam or moisture may be supplied to the clothes.

After that, the control unit may actuate the air supply unit 31. The air supply unit 31 may supply low-humidity-and-high-temperature air to the inner case 2. Accordingly, the moisture supplied to the clothes C may be activated while the air supply unit 31 is actuated. During that process, bad smell may be evaporated from the clothes together with the moisture and wrinkles may be removed from the clothes easily. The pleats may be strengthened during the process.

The detailed description is made with respect to an embodiment in which the moisture chamber 63 is provided in the compression body 61. In other embodiments, the moisture chamber may be provided in the support body 41.

Figure 4:
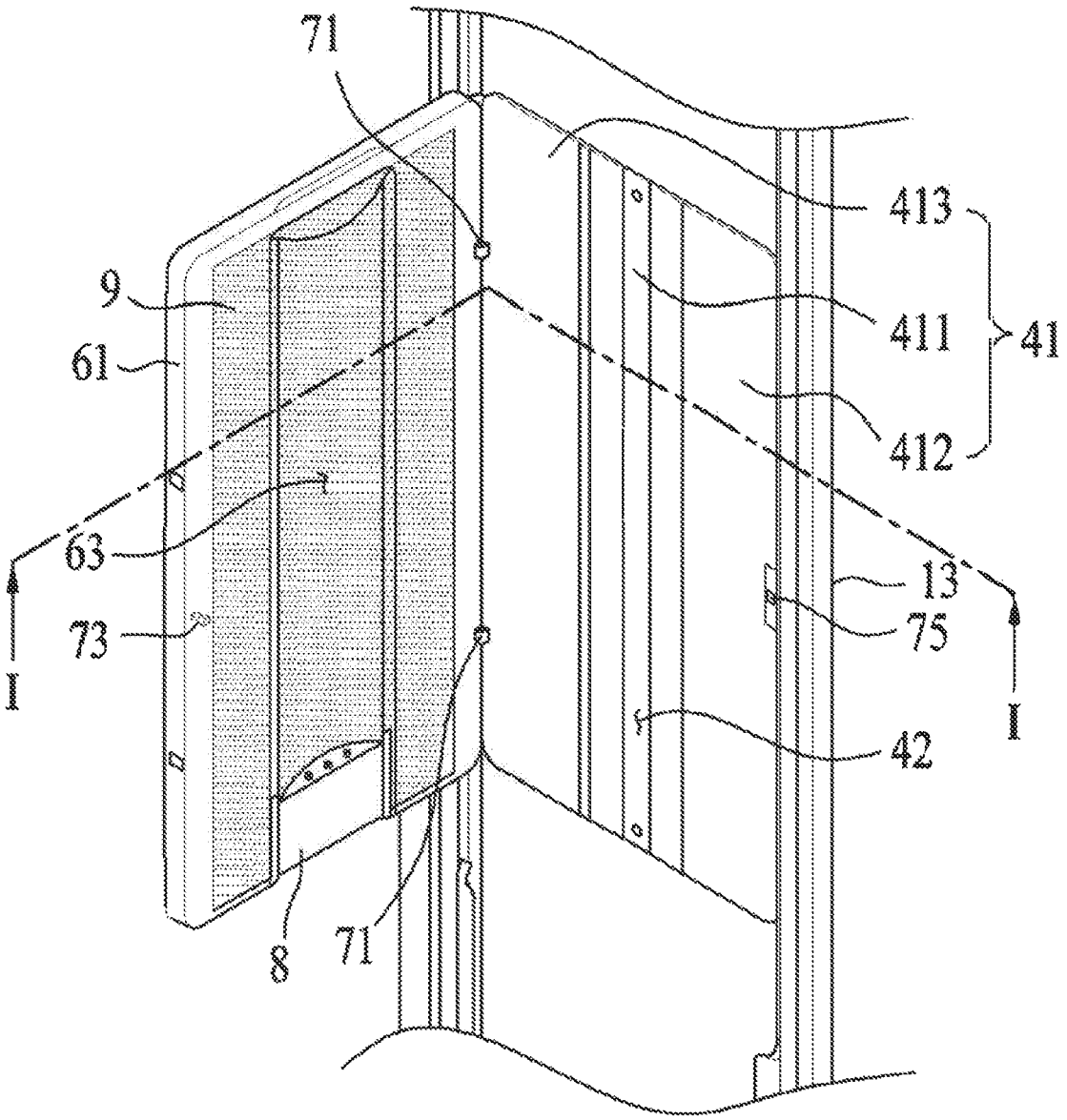
FIG. 4 is a diagram illustrating an exemplary embodiment of a presser configured to supply clothes steam, in accordance with the present disclosure.

As shown in FIG. 4, a first heating unit 9 may be further disposed in the presser P to remove the wrinkles generated in the clothes C more effectively and strengthen the pleats included in the design of the clothes.

Figure 5:
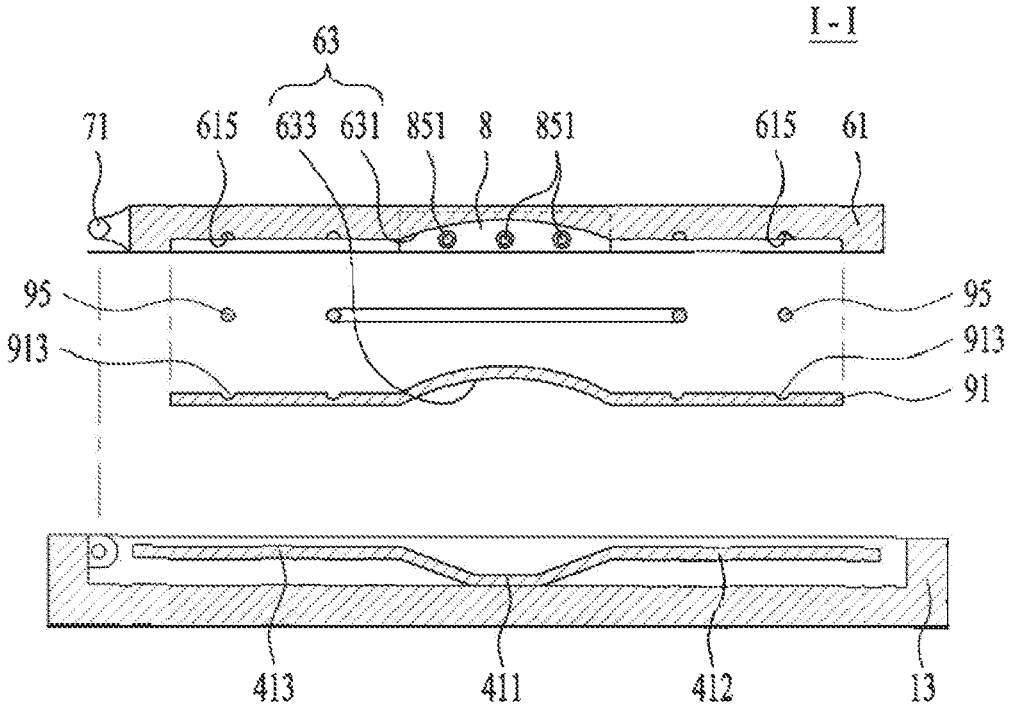
FIG. 5 is a diagram illustrating an exemplary embodiment of a presser configured to supply steam and heat to clothes, in accordance with the present disclosure.

As shown in FIG. 5, the first heating unit 9 may include a heat plate 91 fixed to one surface of the compression body 61 towards the support body 41, and a heat source 95 disposed between the heat plate 91 and the compression body 61 and configured to supply heat to the heat plate 95. The heat plate 91 may be a conductive material such as metal and occupy about 80% or more of the entire area of the compression body 61.

In this instance, the moisture chamber 63 may include a chamber accommodation portion 631 disposed in the compression body 61, and a chamber formation portion 633 disposed in the heat plate 91 to be inserted in the chamber accommodation groove 631.

The heat source 95 may be provided as a wire configured to generate heat when supplied a current. In some embodiments, a heat plate wire groove 913 may be provided to accommodate the wire and a body wire groove 615 may be provided in the compression body 61 to accommodate the wire.

Figure 6:
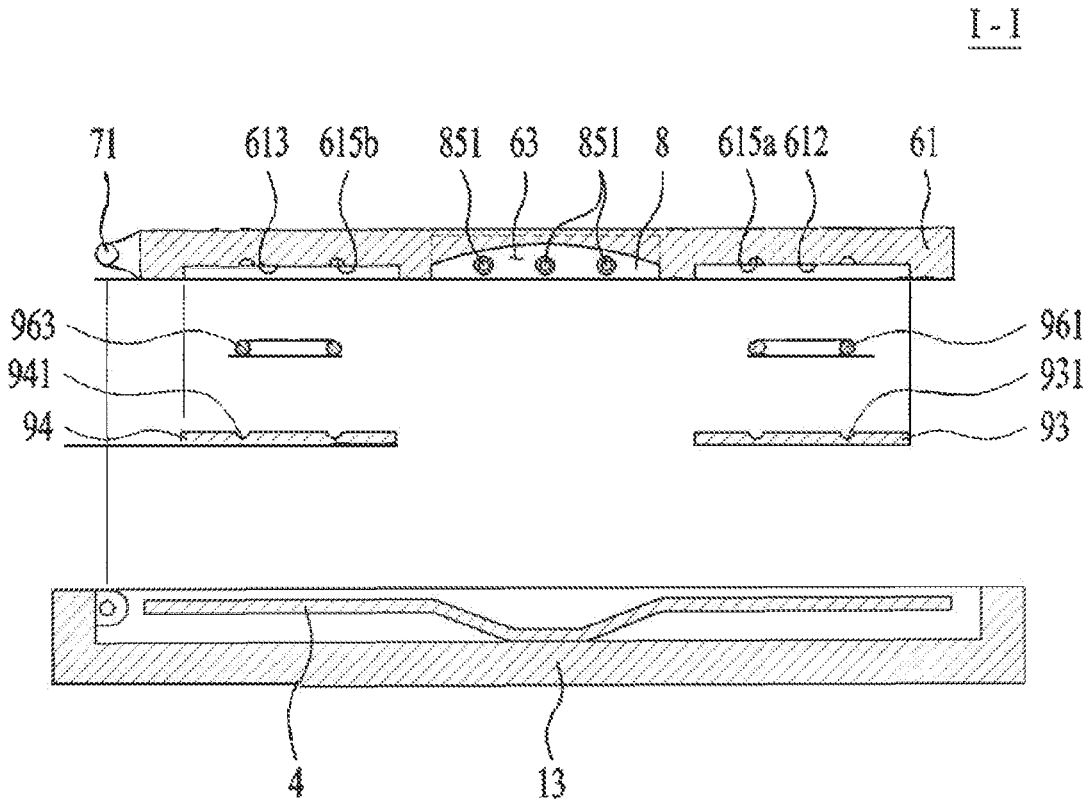
FIG. 6 is a diagram illustrating another exemplary embodiment of a presser configured to supply steam and heat to clothes, in accordance with the present disclosure.

FIG. 6 illustrates another embodiment of the first heating unit 9. The first heating unit 9 in accordance with this embodiment may include a first heat plate 93 (e.g., a conductive material) fixed to the first body 612 of the compression body 61, a second heat plate 94 (e.g., a conductive material fixed to the second body 613), a first heat source 961 disposed between the first heat plate 93 and the first body 612 and configured to supply heat to the first heat plate 93, and a second heat source 963 a supply pipe configured to guide the vapor stored in the moisture supply unit.

The first heat source 961 and the second heat source 963 may comprise wires that may be configured to generate heat when supplied a current. In some embodiments, a first wire groove 931 may be provided in the first heat plate 93 to accommodate the wire and a second wire groove 941 may be provided in the second heat plate 94 to accommodate the wire.

In addition, a first body wire groove 615*a* and a second body wire groove 615*b* may be disposed in the first body 612 and the second body 613 to accommodate the first heat source 9651 and the second heat source 963, respectively.

Figure 7:
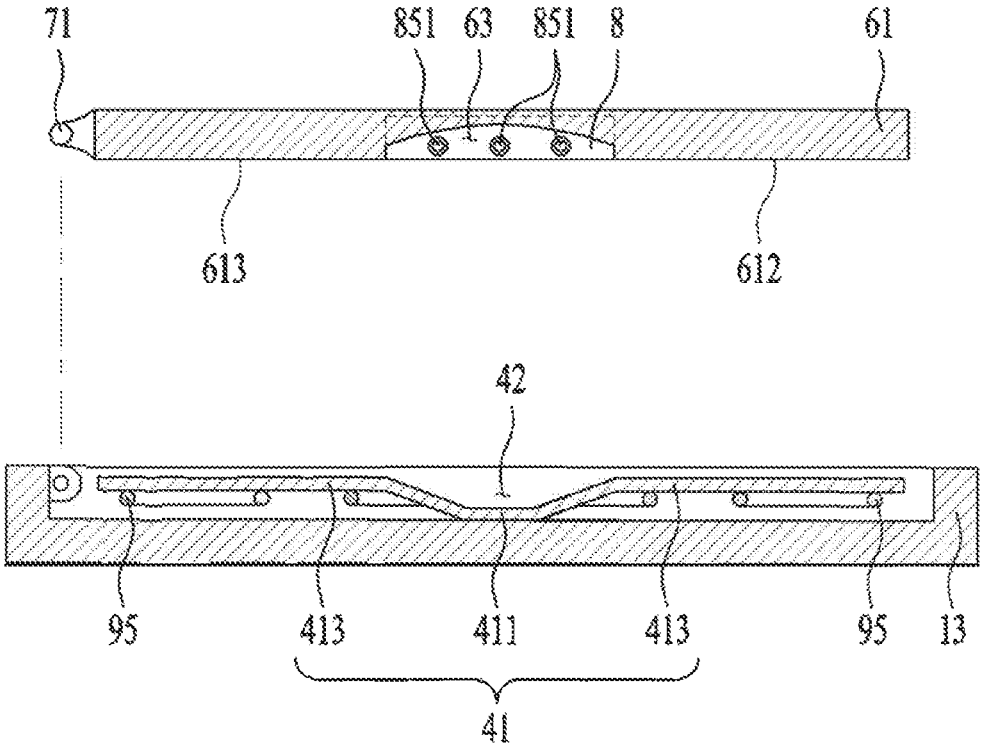
FIG. 7 is a diagram illustrating another exemplary embodiment of a presser configured to supply steam and heat to clothes, in accordance with the present disclosure.

FIG. 7 illustrates another embodiment of the first heating unit 9. The first heating unit 9 according to this embodiment may include a support body 41 and a heat source 95 configured to heat the support body 41.

The support body 41 may have at least a predetermined area that is formed of a conductive material. FIG. 7, for example, illustrates that the entire area of the support body 41 may be formed of a conductive material. The heat source 95 may comprise a wire configured to generate heat when supplied a current and fixed to a rear surface of the support body 41.

The presser P including the above-noted first heating unit 9 may heat clothes by using the first heating unit 9 when or after the moisture supply unit 8 supplies moisture to the clothes. Accordingly, the wrinkle-removing, the pleat-strengthening, the deodorizing and the drying may be facilitated more effectively.

FIGS. 8 through 11 illustrate embodiments of the pressers including only the first heating unit 9.

Figure 8:
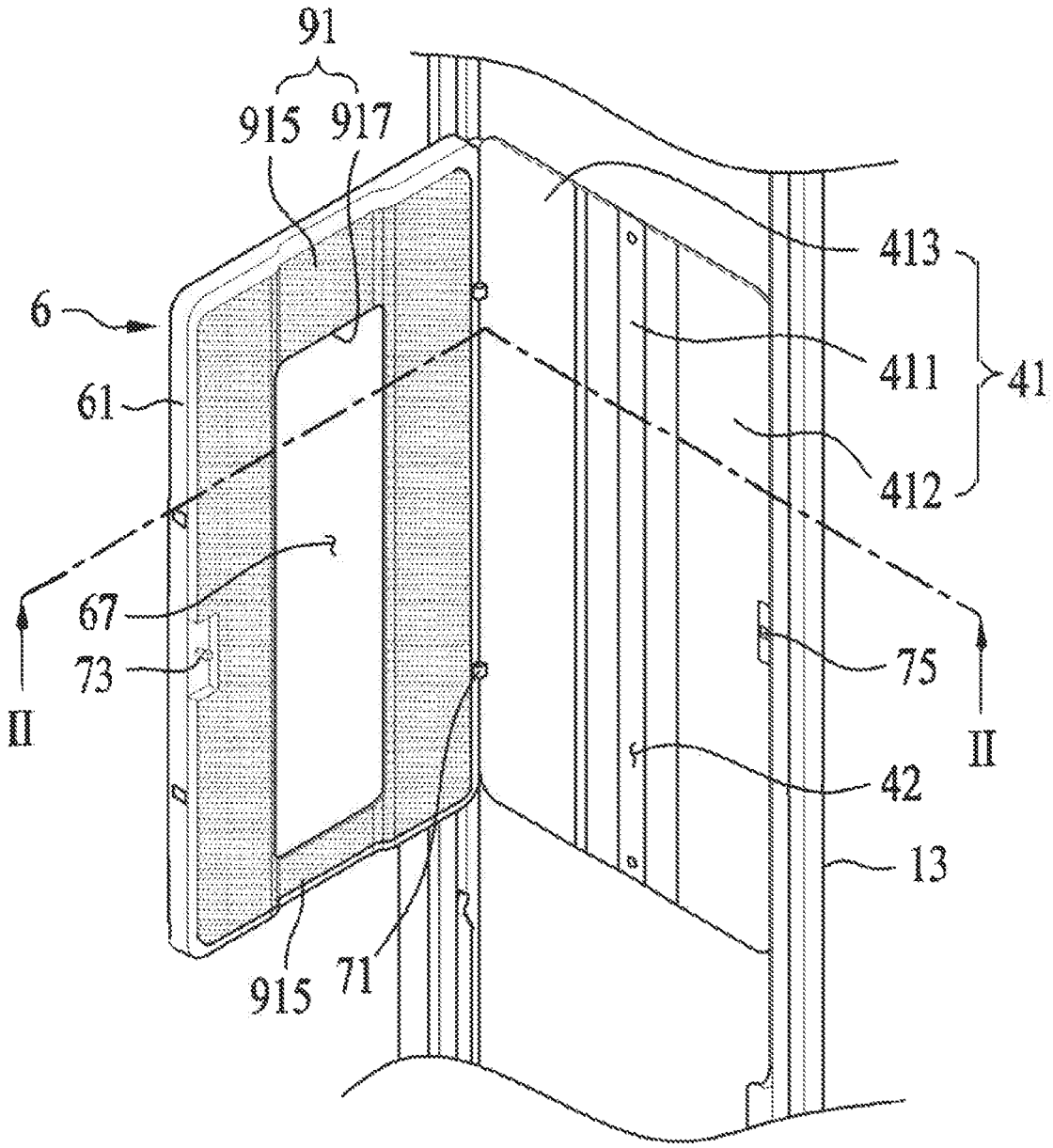
FIG. 8 is a diagram illustrating an exemplary embodiment of a presser configured to supply clothes heat, in accordance with the present disclosure.

The presser P shown in FIG. 8 may include a support unit 4 provided in one of the surfaces defining the inner case 2 and configured to provide a space for supporting the clothes, a compression unit 6 configured to press the clothes supported by the support unit towards the support unit, and a first heating unit 9 disposed in at least one of the support unit and the compression unit and configured to supply heat to the clothes.

The support unit 4 may include a support body 41 fixed to an inner circumferential surface of the door 13 and the compression 6 may include a compression body 61 rotatably coupled to the support body or the inner circumferential surface of the door 13. In some embodiments, the first heating unit 9 may be disposed in at least of the support body 41 and the compression body 61.

The detailed structure of the support body 41 may be equal to the structure of the support body mentioned above and omitted accordingly. A body through hole 67 may be provided in the compression body 61 and the body through hole 67 may comprise a passage formed to guide the air, steam, and moisture supplied to the inner case 2 by the accommodation space air supply unit 31 and the accommodation space moisture supply unit 34.

The first heating unit 9 may include a heat plate 91 disposed in one surface of the compression body 61 towards the support body 41 as the conductive material, a through hole 917 provided through the heat plate 91 to communicate with the body through hole 67, and a heat source 95 configured to supply heat to the heat plate 91.

Figure 9:
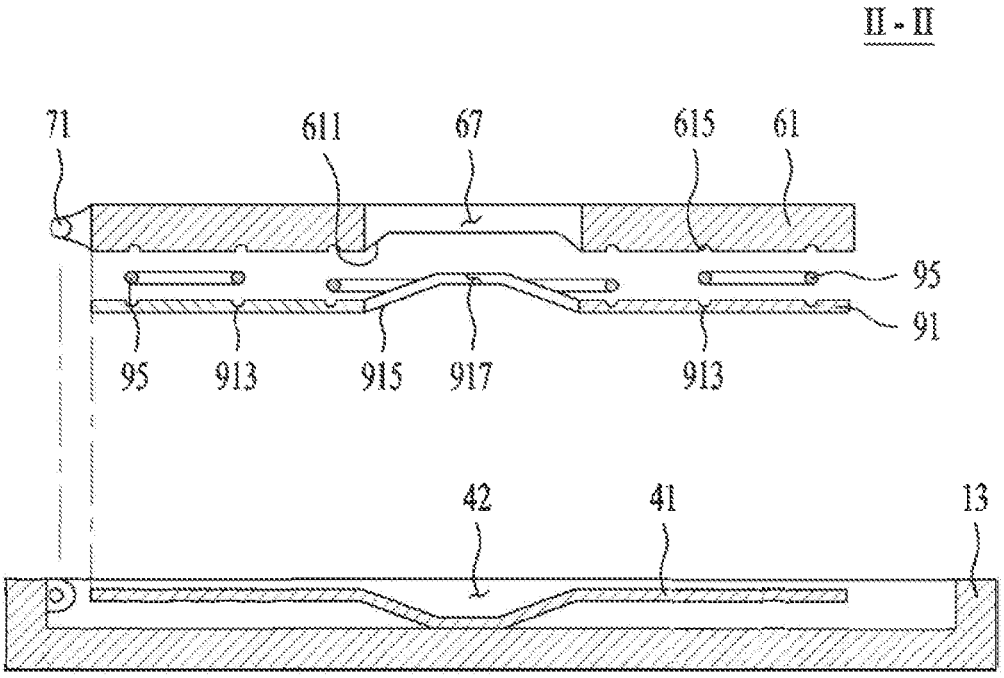
FIG. 9 is a diagram illustrating another exemplary embodiment of a presser configured to supply clothes heat, in accordance with the present disclosure.

As shown in FIG. 9, the compression body 61 may include a compression body groove 611 disposed along a height direction of the compression body. A first body 612 and a second body 613 may be formed in both sides of the compression body groove 611 along the height direction of the compression body 61.

The heat plate 91 may include a heat plate groove 915 disposed in the compression body groove 611. The heat plate groove 915 may accommodate the sewing line of the clothes. When the compression body 61 contacts with the support body 41, the heat plate groove 915 may form an upper surface of the support body groove 42.

The laundry treating apparatus 100 including the above-noted presser P may supply moisture to the clothes via the body through hole 67 and the heat plate through hole 917 when the moisture supply unit 34 is actuated. After the control unit supplies the power to the heat source 95, the heat plate 91 may be heated and the heat of the heat plate 91 may be transferred to the clothes. While a pressure is applied to the clothes supplied the moisture by the compression body 61, heat may be supplied to the heat plate 91, and then, the deodorizing and the winkle-removing may be facilitated.

Figure 10:
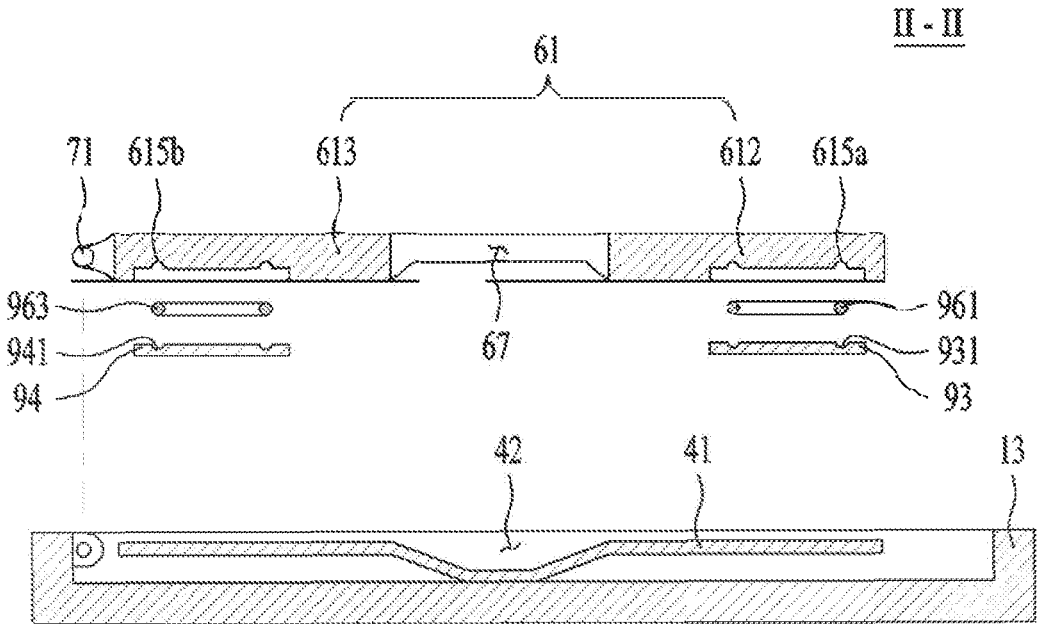
FIG. 10 is a diagram illustrating another exemplary embodiment of a presser configured to supply clothes heat, in accordance with the present disclosure.

The first heating unit 9 shown in FIG. 10 may include a first heat plate 93 (e.g., a conductive material) fixed to the first body 612, a second heat plate 94 fixed to the second body, a first heat source 961 disposed between the first heat plate 93 and the first body 612 and configured to supply heat to the first heat plate, and a second heat plate 963 disposed between the second heat plate 94 and the second body 613 and configured to supply heat to the second heat plate.

The heat sources 961 and 963 may comprise wires that generate heat when supplied electric currents. Grooves 931, 941, 615*a* and 615*b* may be provided in each of the heat plate 93 and 94 and each of the bodies 612 and 913.

Figure 11:
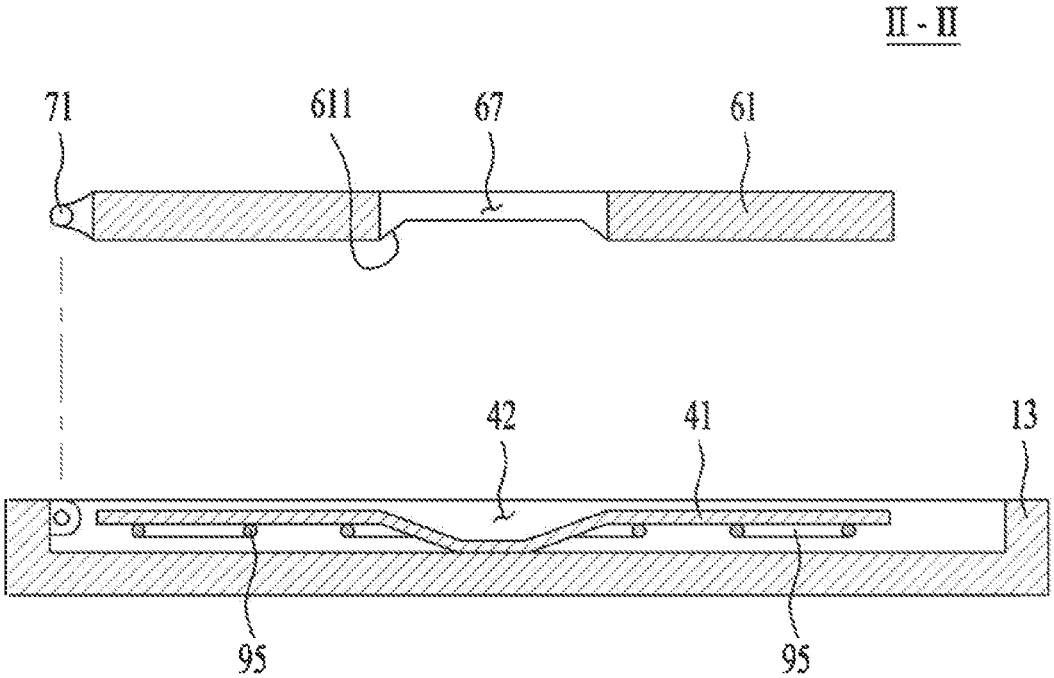
FIG. 11 is a diagram illustrating another exemplary embodiment of a presser configured to supply clothes heat, in accordance with the present disclosure.

The first heating unit 9 shown in FIG. 11 may have at least a predetermined area that is formed of a conductive material heated by the heat source 95. The heat source 95 may comprise a wire that generates heat when supplied a current and fixed to a rear surface of the support body 41.

Figure 12:
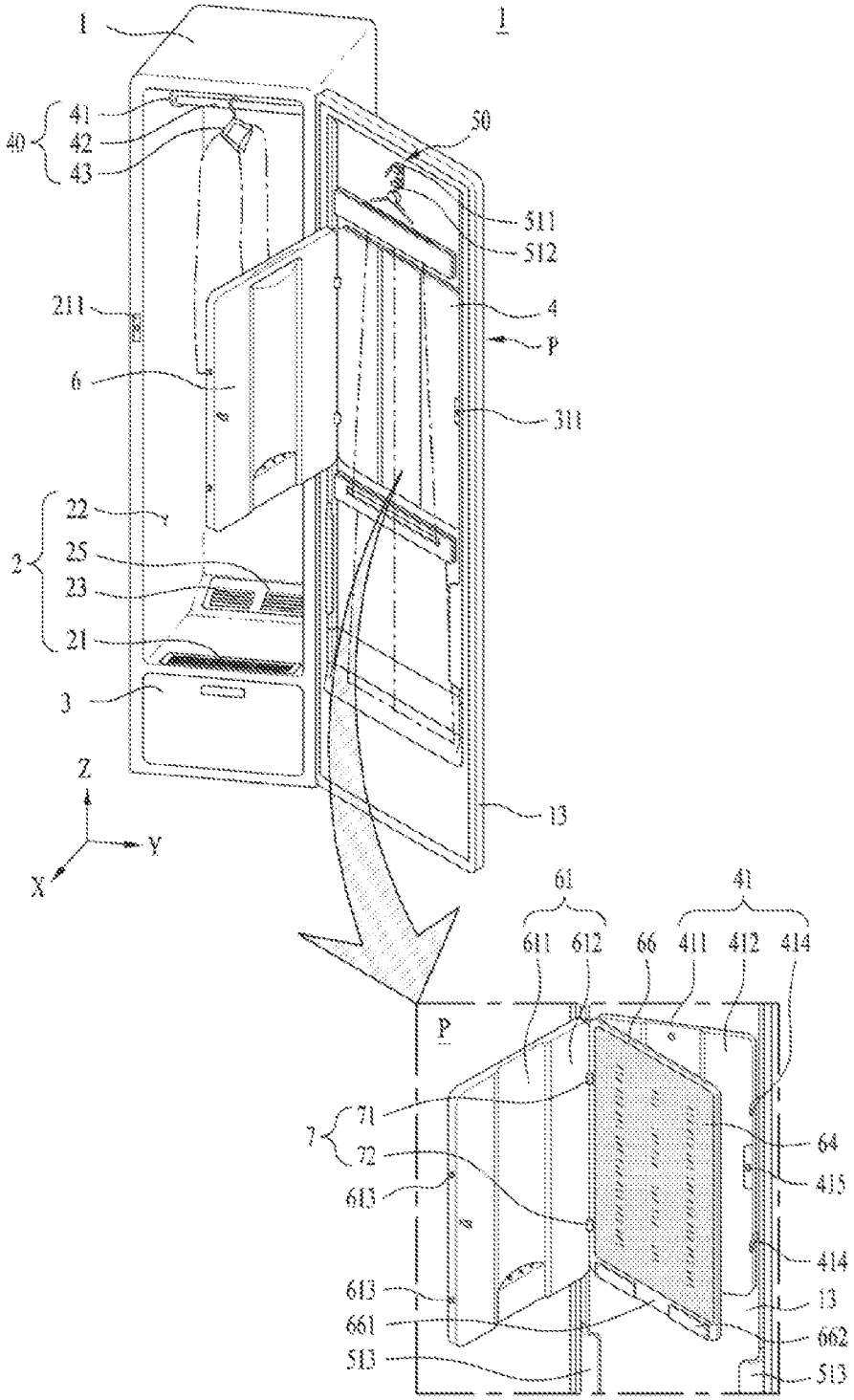
FIG. 12 is a diagram illustrating an exemplary structure of another embodiment of the laundry treating apparatus, in accordance with the present disclosure.

FIG. 12 illustrates the laundry treating apparatus, in accordance with the present disclosure.

Referring to FIG. 12, the laundry treating apparatus may include a cabinet 1 having an opening formed in a front, a door 13 rotatably coupled to the cabinet 1 and configured to open and close the opening, an inner case 2 disposed in the cabinet and configured to define an accommodation space 22 for accommodating clothes C a machine room 3 in communication with inner case 2 and configured to supply at least one of the air, steam, and moisture to the accommodation space 22, and a presser provided in at least one of the inner case 2 or door 13 and configured to press the clothes.

The cabinet 1 may define an exterior design of the laundry treating apparatus and the height may be larger than the width. Accordingly, even long clothes C like trousers may be loaded in the accommodation space 22 without being folded, and thus, wrinkles may be then prevented.

The cabinet 1 may be formed of metal and/or resin such as reinforced plastic as long as the strength is maintained.

The inner case 2 may further include the machine room 3 disposed in the cabinet 1 and configured to define the accommodation space 22. The machine room 3 may be formed of a preset material that is able maintain the strength, without being deformed or activated chemically by the foreign substances discharged from the clothes C or the hot air, steam, or moisture supplied from the electric control units. As one example, the preset metal may comprise polystyrene (e.g., ABS and ASC).

The inner case 2 may be in communication with the machine room 3 via one surface of a lower area to have hot air, steam, or moisture suppled or discharged from and to the machine room 3.

The machine room 3 may be disposed in the cabinet 1 and be separated from the accommodation space 22. The machine room 3 may be disposed in a lower area of the accommodation space 22 to supply the heated air, steam, or moisture having a relatively lower intensity than air.

In some embodiments, the air supplied to the accommodation space 22 by the electric control unit may be the heated air. The moisture supplied to the accommodation space 22 by the machine room 3 is may comprise steam, and the machine room 3 may be located under the accommodation space 22 and the heated air or steam may be uniformly supplied to the accommodation space 22 without auxiliary ventilation device.

Meanwhile, the door 13 may be rotatably coupled to the cabinet 1 to open and close the opening. The door 13 may close not only the machine room 2 but also a front area of the machine room 3. Accordingly, the heated air, steam, or moisture supplied to the accommodation space 22 may be prevented from being discharged outside and the heat generated in the machine room 3 may be prevented from being transmitted outside.

The door 13 may be provided to open and close the front area of the machine room 3 such that an inner surface of the machine room 3 and an inner surface of the door 13 may form an outer surface of the accommodation space 22.

The presser P may pressure the clothes C from both surfaces to remove the wrinkles generated in the clothes C or put a crease that is intended by the user.

In other words, the presser P may function as an iron such that the user may not have to perform additional ironing after drying and deodorizing the clothes C.

The clothes C including tops and bottoms that require ironing may be pressed in the presser C.

In some embodiments, the presser P may include a support unit 4 disposed in one of the surfaces that defines the inner case 2 and configured to provide a predetermined space for supporting the clothes, and a compression unit 6 configured to press the clothes supported by the support unit towards the support unit.

FIG. 12 illustrates that the support unit may be disposed on the surface of the door 13. In some embodiments, when supporting one surface of the clothes, the support unit may be disposed in an inner surface of the machine room 2.

The support unit 4 may include a support body 41 formed in a plate shape not to deform the shape of the clothes when one surface of the clothes is pressed. In some embodiments, the support body 41 may include a support surface 412 configured to provide surface-contact with the clothes, and a securing portion 411 recessed from the support surface 412 along a longitudinal direction to concentrate the force applied to both sides of the clothes C.

Accordingly, when the compression unit 6 presses the support body 41, the pressure may be concentrated on the support surface 412 and the winkles may be effectively removed from the clothes C. Also, a crease may be formed in each of the both ends of the clothes clearly. In addition, the pleat not intended by the user may be prevented from the clothes C by the sewing line.

The compression unit 6 may be rotatably coupled to the support body 41 or the inner surface of the machine room 4 accommodating the support body 41 or the inner surface of the door 13. In other words, the compression unit 6 may be provided in any areas if rotating farther or closer from or to the support body 41.

The compression unit 6 may include a compression body 61 rotatably coupled to the support body 41 or the door 13.

The compression unit 61 may be rotatably coupled via a connection hinge 7 disposed in at least one of the machine room 3, the door 13 or the support body 41.

The connection hinge 7 may be provided in the support body 41 or the machine room having the support body 41 or the inner surface of the door 13.

The connection hinge 7 may include a first connection hinge for rotatably connecting the compression body 61, and a second connection hinge 72 disposed under the first connection hinge to rotatably connect the compression body.

The compression body 61 may further include a body 612 rotatably disposed towards the support body 41, and a compression body groove 611 recessed along a longitudinal direction of the body 612 to avoid the sewing line of the clothes or concentrate the force pressed to the both sides of the clothes C.

Accordingly, the compression body 61 may be configured to rotate towards the support body 41 and press one surface of the clothes C. The support body 41 may press the other surface of the clothes C by using action and reaction.

Meanwhile, the presser P may further include a partition unit 66 rotatably disposed between the support body 41 and the compression unit 6 towards the support body and the compression body.

In some embodiments, the partition unit 66 may include a partition body 661 rotatably disposed between the support body 41 and the compression unit 6. The partition body 61 may comprise an area corresponding to the area of the compression unit 6 and the support body 41. Accordingly, the clothes arranged in at least one of the compression unit 6, the partition body 61 or the support body 41 may be pressed.

The partition body 61 may be also rotatably coupled to the first connection hinge 71 and the second connection hinge 72 to be independently rotatable from the compression body 61 and be rotatably integral with the compression body 61.

The partition body 61 may be independently rotatable towards the support body 41 and pressed when the compression body 61 is rotating towards the support body 41 to rotate towards the support body 41.

Figure 13:
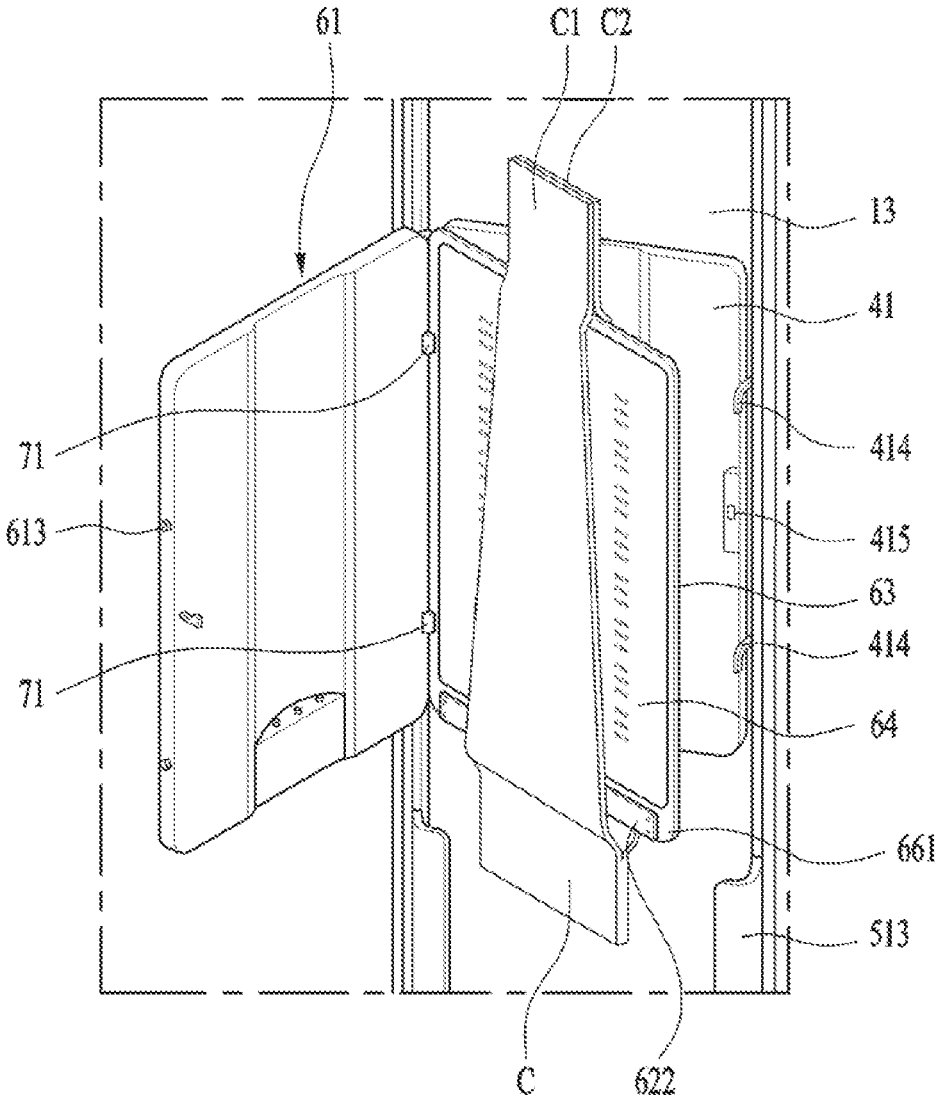
FIG. 13 is a diagram illustrating another embodiment of the presser that clamps on clothes, in accordance with the present disclosure.

FIG. 13 illustrates one embodiment in which the clothes C are pressed by the presser P.

Referring to FIG. 13, when the clothes C comprise trousers and are divided into a first part C1 wearable on the user's left leg and a second part C2 wearable on the user's right leg, the first or second part may be pressed by the compression body 61 and the partition body 661, and the other part may be pressed by the partition unit 66 and the support body 41.

For example, the first part C1 and the second part C2 of the clothes C may be arranged in an upper or lower end of the partition body 661. The first part C1 may be supported by one surface of the partition body 661 towards the compression body 61 and the second part C2 may be supported by the other surface directed towards the support body 41, respectively.

At this time, the first part C1 and the second part 2P may be folded again and secured to the upper or lower area of the partition body 61. Accordingly, the first part C1 and the second part C2 of the clothes may be unfolded by their weights without being overlapped with each other. Also, the first part C1 and the second part C2 may be precisely pressed enough to remove wrinkles from the clothes or form creases on both sides of the clothes.

Meanwhile, a keeping stand 662 may be further provided in one surface or both surfaces of the partition body 661.

The keeping stand 662 may prevent the support body 41 and the compression body 41 and the compression body 61 from contacting too closely with each other, and the keeping stand 62 may also prevent the position of the clothes C from being changed when pressed by the compression body 61 or the partition body 661.

In some embodiments, the keeping stand 62 may be formed of a material with a higher friction force than the partition body 661 or a buffer power.

The partition unit 66 with a predetermined thickness and the clothes may be arranged between the support body 41 and the compression body 61. Accordingly, even when the compression body 61 presses, the compression body 61 might be configured to rotate towards the opposite direction of the support body 41.

Accordingly, to prevent the compression body 61 from rotating towards the opposite direction of the support body 41, the laundry treating apparatus 100 may further include a coupling hook 414 provided in the support body 41 and configured to secure the compression body. The hook coupling portion 613 may be disposed in the compression body and secured to the coupling hook.

As one example, the hook coupling portion 613 may include a hook projection 613 projecting from a circumference of the compression body 61. The coupling hook 414 may be formed in a hook shape to be coupled to the hook projection 613.

In some embodiments, when the coupling hook 414 is insertedly coupled to the hook coupling portion 613 and the support body 41 is coupled to the compression unit 6 to keep the compression unit 6 to press the partition unit 66 and the support body 41, they may be formed in any shapes.

FIG. 13 illustrates an exemplary embodiment in which the clothes may include trousers. In other embodiments, a plurality of pieces of clothes may be installed in the presser P. In other words, when the plurality of pieces of the clothes are provided, one piece may be arranged between the partition unit 66 and the compression unit 6 and another piece may be arranged between the partition unit 66 and the support body 41.

Accordingly, when the compression unit 6 is rotated towards the support body 41, the compression unit 6 may press one piece of the clothes by using the partition body 661 and the partition body 661 may press another piece by using the support body 41.

Accordingly, wrinkles may be removed or creases may be put by using one presser P in pressing the plurality of pieces of clothes.

Furthermore, when the clothes comprise tops, one of the tops may be inserted in an outer surface of the partition body 662 and secured to accommodate the partition body 661 such that one surface and the other surface of the clothes may be pressed by the compression unit 6 and the support body 41.

Meanwhile, when the partition unit 66 is disposed between the support body 41 and the compression body 61, it might be difficult to supply the clothes C the steam, moisture, or heated air supplied from the machine room 3. Accordingly, the presser C may be provided with an additional structure configured to supply heat or steam to the clothes C.

Meanwhile, the support body 41 may include a coupling portion 311 configured to detachably couple the partition body 61. The support coupling portion 415 may comprise a hook that partially receives the outer surface of the partition body 61, and the coupling portion provided in the compression unit 61 may be coupled at the same time.

Figure 14:
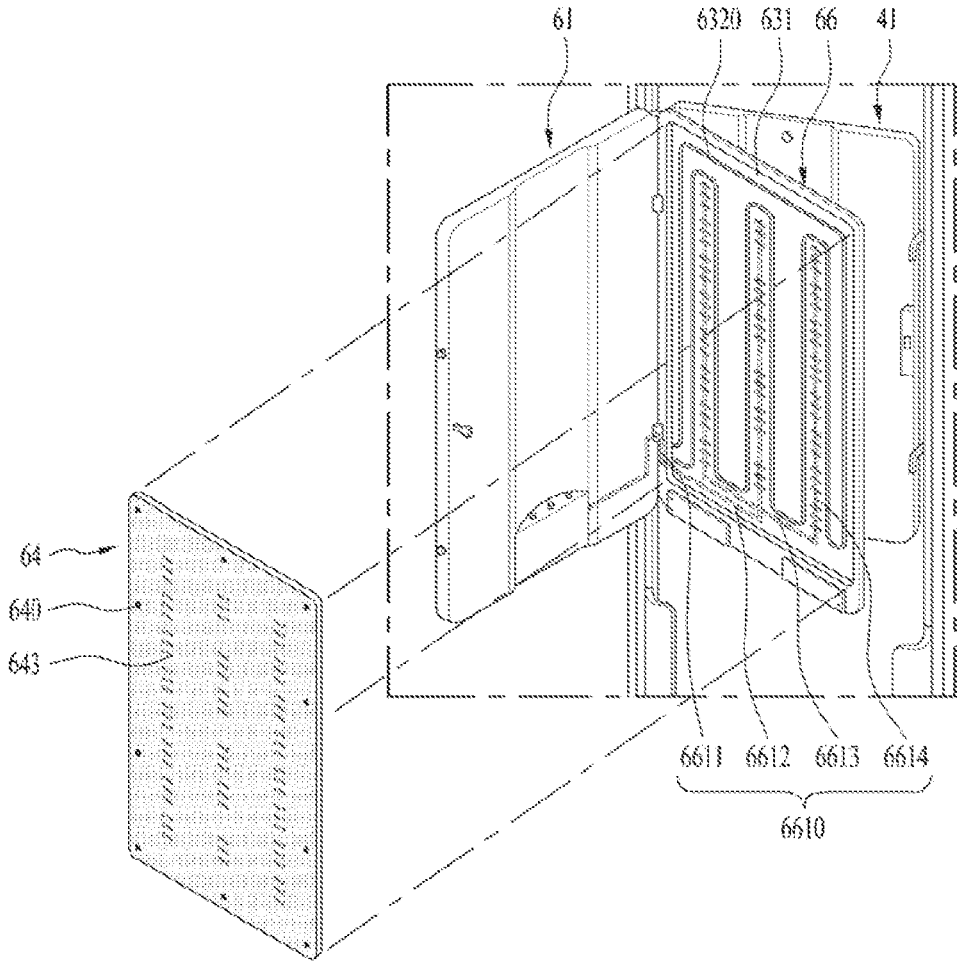
FIG. 14 is a diagram illustrating an exemplary embodiment of a second heating unit installed in an embodiment of the presser, in accordance with the present disclosure.

FIG. 14 illustrates an exemplary structure configured to additionally supply heat or steam to the presser P.

Referring to FIG. 14, the partition unit 66 may include a second heating unit 64 disposed in at least one of the two surfaces of the partition body 61 and configured to supply heat to the clothes C.

The second heating unit 64 may supply a thermal energy to the clothes pressed between the support body 41 and the compression body 61 to effectively remove the wrinkles or form the creases.

The second heating unit 64 may include a heating body 640 disposed in at least one of the two surfaces of the heating body 640 and configured to be exposed outside, and a heat wire 6620 disposed in the heating body 640 and configured to heat the heating body 640.

The heating body 630 may be formed of a conductive or metal material. The heat wire 6620 may be heated by an electric energy to transmit the heat to the heating body 640.

The heating body 640 may be detachably coupled to the both surfaces of the partition body 661 to form an exposed surface of the partition body 661.

When the heating body and the partition body are formed of the same material, the heating body 640 may be integrally formed with the partition body 661.

The heat wire 6620 may be attached to a rear surface of the heating body 640. In some embodiments, the heat wire 6620 may be disposed in the partition body 661. In other words, the heat wire 6620 may be disposed in the partition body 661, spaced a preset distance from the heating body 640, to indirectly heat the heating body 640.

The heat wire 6620 may be supplied an electric energy from the cabinet 1 or the machine room 3 and be connected with the outside of the presser P via the first connection hinge 71 or the second connection hinge 72. The heat wire 6620 may be uniformly installed in both surfaces of the partition body 661 while reciprocating along the height direction and the width direction.

Meanwhile, the second heating unit 64 may include a supply path 6610 disposed in the partition body 661 or the heating body 640 to supply steam, and a plurality of discharge holes 643 formed through the heating body 640 to discharge the steam to the clothes.

The supply path 6610 may be formed to supply water and the water may be heated by the heat wire 6620 and changed into steam such that the steam may be discharged via the discharge hole 643. The supply path 6610 may comprise a path configured to supply the steam or mist directly.

A plurality of supply paths 6610 may be disposed along the height or width direction of the partition body 661, spaced apart from each other. The discharge hole 643 may be disposed in an extended direction of the supply path 6610. Accordingly, the steam may be supplied to the clothes C via the discharge holes 643.

The second heating unit 64 may include at least one of the supply path 6610 or the heating wire 6620.

Meanwhile, when the second heating unit 64 includes both of the supply path 6610 and the heat wire 6620, the heat wire 6620 may be disposed in an outer area of the supply path 6610 not to be interfered with. Also, the heat wire 6620 may be disposed along an outer circumference of the supply path 6610.

Meanwhile, the partition unit 66 may be rotatably disposed in the machine room 3 or the door 13. Accordingly, the partition unit 66 may be restricted to form the path for supplying stem to the supply path 6610.

The supply path 6610 may include a main path 6612 embedded in the partition body 661 or formed in one surface of the partition body 661, a plurality of branched paths 6613 branched from the main path 6612 in a height or width direction of the partition body 661 and configured to supply steam, and a spray path 6614 extended from each of the branched paths 6613 in the same direction to supply steam.

At this time, the intensity of the steam is light such that the auxiliary branched paths 6614 may be provided in the height direction, spaced a preset distance apart from each other in the width direction to spray steam to larger areas.

Accordingly, the steam or moisture or water supplied via the main path 6612 may be distributed along the spray paths and uniformly sprayed from the partition body 661.

The supply path 6610 may further include a communication path 6611 provided in communication with a moisture supply source 80 provided in the outside of the partition body 661 to transmit the water or steam to the main path 6612.

The heat wire 6620 may be configured to communicate with the first connection hinge 71 or the second connection hinge 72 and the main path 6612 may be configured to communicate with the other one of the two hinges, not to be overlapped with each other.

For that, a path unit 8111 and 821 may be provided in the first connection hinge 71 and the second connection hinge to pass the heat wire or the main path 6611 there through or allow them to communicate with each other.

Figure 15:
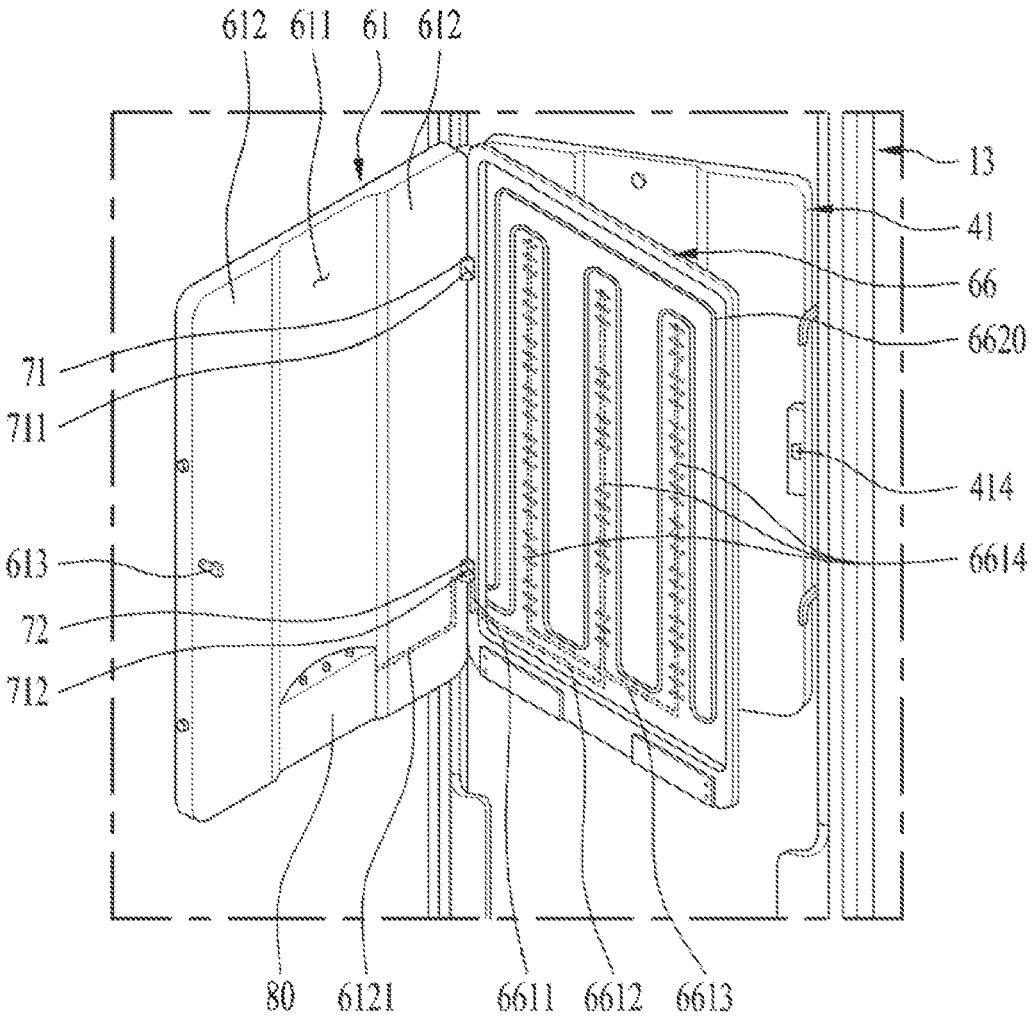
FIG. 15 is a diagram illustrating an exemplary embodiment of a passage structure of the second heating unit provided in the laundry treating apparatus, in accordance with the present disclosure.

FIG. 15 illustrates the exemplary structure in which the moisture supply source 80 may be installed to supply steam to supply steam.

The moisture supply source 90 may be disposed in a proper area that facilitates the user's access in the cabinet, the electric control unit, the door and the pressure unit.

The moisture supply unit 80 may be disposed in at least one of the cabinet, the electric control unit, the door or the pressure unit. As the laundry treating apparatus is likely to be connected with no external water supply source, the moisture supply source 80 may be detachably disposed in at least one of the cabinet, the electric control unit, the door or the pressure unit.

In addition, the moisture supply source 80 may be installed in the closet area to the supply path 6610 such that it is provided in the partition unit 66. The compression unit 6 may comprise a first area exposed to the user such that it may be provided in the compression unit 6.

When the moisture supply source 80 is detachably installed in the compression unit 6, the compression unit 6 may further include a connection path 6121 provided to allow the moisture supply source 80 to communicate with the connection hinge 7.

The connection path 6121 may be provided in a plate shape to discharge the moisture or steam supplied from the moisture supply source 80 and inserted in the compression unit 6.

Accordingly, the connection path 6121 and the communication path 6611 may be able to communicate with each other so as to discharge the moisture or steam generated in the moisture supply source 80 to the discharge hole 643 completely.

Meanwhile, the supply path 6610 may be disposed in the partition body 661 and the partition body 661 may include a plurality of through holes provided to communicate with the discharge holes 643 of the second heating unit 64.

Accordingly, the supply unit 631 may be disposed in the partition body 661, not in each of the surfaces of the partition body 61, to reduce the thickness of the partition body 661. Also, the steam may be supplied to the both surfaces of the partition body 661 via one supply path 6610.

Figure 16:
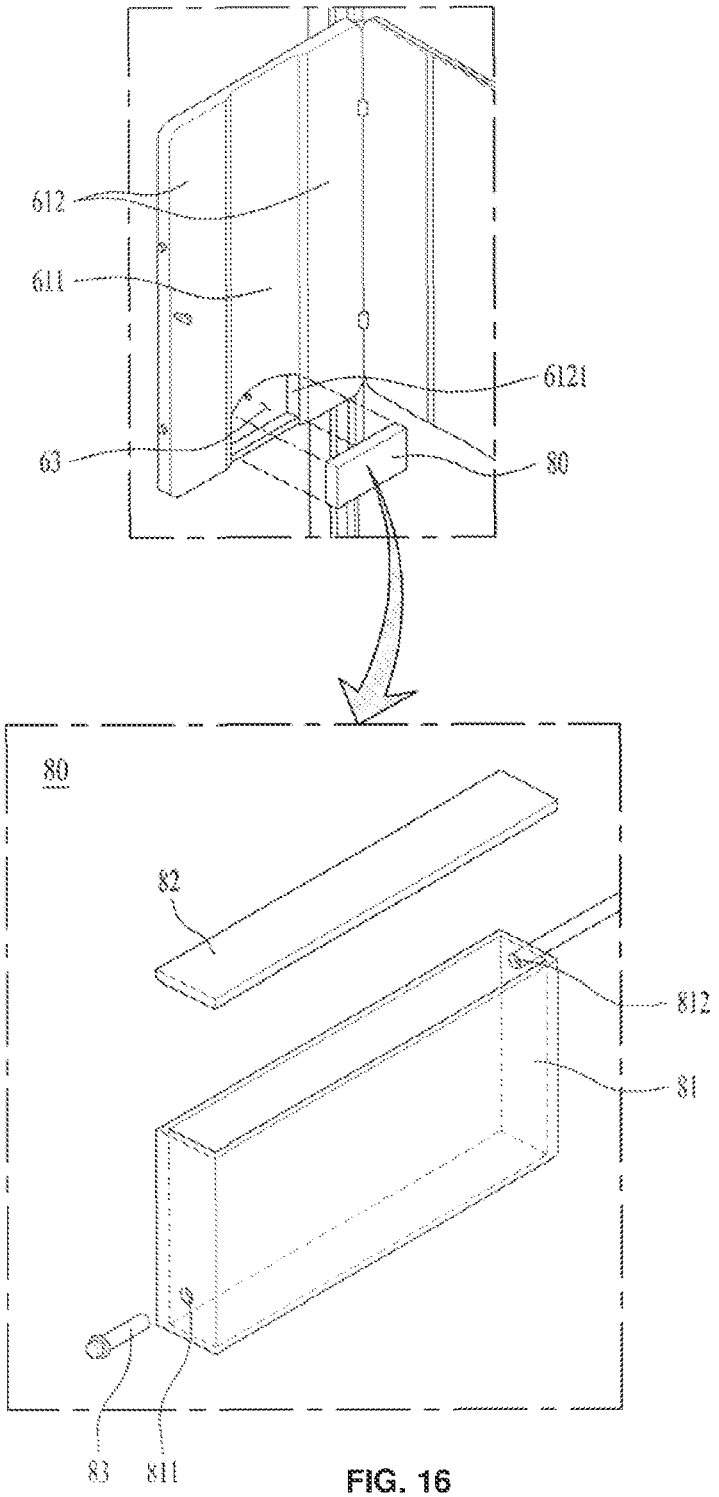
FIG. 16 is a diagram illustrating an exemplary embodiment of a moisture supply structure provided in an embodiment of the second heating unit, in accordance with the present disclosure.

FIG. 16 illustrates an exemplary embodiment of the moisture supply source 80.

As mentioned above, the moisture supply source 80 may be detachably disposed in the compression unit 6.

The moisture supply source may include a water tank detachably disposed in at least one of the pressure units and configured to hold water, a heater 83 configured to generate steam by heating the water held in the water tank, and a discharge hole 812 configured to discharge steam while communicating with the water tank and the supply unit.

The water tank 810 may be provided in a case shape with a preset volume and it may have an open upper surface to facilitate washing thereof and a structure for closing the open surface.

The water tank 810 may include a heater inserting hole 811 configured to insert the heater 83 therein and the heater 83 may be secured to the heater inserting hole 811 and configured to generate steam by heating the water held in the water tank 810.

The discharge hole 812 may be provided in a predetermined upper area of the water tank 810, in communication with the connection path 6121, to completely discharge the steam with the relatively lower intensity.

The compression unit 6 may include an accommodation portion 613 provided to accommodate the water tank 810. When the water tank 810 is mounted in the accommodation portion 613, the exposed surface of the water tank 810 may be provided in parallel with one surface of the compression unit 6.

Accordingly, when water is supplied to the water tank, steam may be supplied to the clothes C via the second heating unit 64.

In some embodiments, the second heating unit 64 may directly supply heated-air, steam, or moisture by communication with the machine room 3 or the water tank 810 to discharge the heated air, steam, or moisture towards the support body 41.

In other words, the second heating unit 64 may comprise a discharge hole 643 integrally formed with the partition body 661 and configured to discharge the heated air, steam, or moisture.

The first connection hinge 71 and the second connection hinge 72 may include paths that are in communication with the machine room 3. The partition body 661 may include a supply path configured to supply heated air, steam, or moisture to the second heating unit 64 by communication with the path.

When the second heating unit 64 is in communication with the machine room 3, the heated air, steam, or moisture supplied to the accommodation space 22 from the machine room 3 may be supplied even to the second heating unit 64.

FIGS. 17A-B illustrates an exemplary structure of the clamp provided to secure the clothes to the presser P.

FIG. 17A illustrates an embodiment in which the clothes may be separated from the presser P. FIG. 17B illustrates an embodiment in which the clothes may be hung on the presser P.

The laundry treating apparatus may further include a clamp 62 disposed in at least one of the upper or lower areas of the presser P and configured to allow the clothes to clamp or be hung thereon.

The clamp 62 may include a clamp body 6211 and 6221 disposed in at least one of the upper or lower areas of the pressure unit, and a fixed body 6212 and 6222 coupled to the clamp body to secure the clothes to the clamp body.

The clamp body 6211 and 6221 may secure the clothes in a state of being tight. When the clothes are pressed by the compression unit 6, the clothes may be prevented from being wrinkled or moved.

At this time, if the clamp 62 is secured in a state where the partition unit 66 is rotating, the clothes might be damaged. Accordingly, the clamp body 6211 and 6221 may be rotary, corresponding to the partition unit 66.

The fixed body 6211 and 6222 may be rotatably coupled to the clamp body 6211 and 6221 such that the clothes may be fitted between the fixed body 6212 and 6222 and the clamp body 6211 and 6221.

The clamp body 6211 and 6221 may be hook-coupled to the fixed body 6212 and 6222 to prevent the clothes C from falling or moving freely. For example, a hook coupling portion 6211*b* may be provided in the clamp body 6211 and 6221 and the fixed body 6212 and 6222 may include a coupling hook portion 6212*b* having the coupling hook coupled thereto.

In some embodiments, the clamp 62 may be installed only in the upper area of the presser P and secure the clothes C such that the clothes may be tightened by their weights.

However, when the load applied by the presser P to press the clothes is relatively large or directed towards the other surface of the clothes from one surface, the position of the clothes may be changed or wrinkled.

Accordingly, the clamp 62 may be provided in the upper and lower areas of the presser P and provide a sufficient tension to the cloths C to prevent the wrinkles or position change of the clothes C.

Referring to FIG. 17A, the clamp 62 may include a first clamp portion 621 disposed in the upper area of the presser P; and a second clamp portion 622 provided in the lower area of the presser P.

The first and second clamp portions 621 and 622 may be rotatable together with the partition unit 66.

The first clamp portion 621 may include a first clamp body 6211 rotatably coupled to an upper area of the partition unit 66, and a first securing body 6212 rotatably coupled to an upper area of the partition unit 66 and configured to secure the clothes.

The first clamp body 6211 may be provided in a plate shape having a length longer than the width, and the first securing body 6212 may be rotatably coupled to the first clamp body 6211, with a free end detachably coupled to the first clamp body 6211.

The first clamp body 6211 may include an accommodation groove 6211*a* gently curved from one surface to accommodate the clothes. Accordingly, the clothes may be prevented from being pressed excessively.

In some embodiments, the second clamp portion 622 may include a second clamp body 6221 rotatably coupled to a lower area of the partition unit 66, and a second securing body 6222 rotatably coupled to the second clamp body to secure the clothes.

The second clamp body 6221 may include a first through slit 6221*d* which the first part C1 of the clothes may be inserted in to penetrate and a second through slit 6222*c* which the second part C2 may be inserted in to penetrate.

Accordingly, the first part C1 and the second part C2 of the clothes C may be inserted in the first through slit and the second through slit to partition off the overall area into both sides of the partition unit 66.

Referring to FIG. 17B, the first part C1 of the clothes C may be inserted in the second through slit 6222*c* and guided between one surface of the partition unit 66 and the compression unit 6. The second part C2 may be inserted in the first through slit 6221*d* and guided between the other surface of the partition unit 66 and the support body 41.

Also, the first part C1 and the second part C2 may overlap with each other in the upper area of the presser P to be inserted in the first clamp body 6211 and the first securing body 6212.

At this time, the first and second parts C1 and C2 may be fixedly inserted in the first clamp body 6211 and the first securing body 6212, in a state of being tightened.

In other embodiments, the first clamp portion 621 may be provided as a through slit and an accommodation groove may be formed even in the second clamp portion 622. Accordingly, the user may be able to adjust the clamp direction of the clothes C as necessary.

FIGS. 18A-D illustrate an exemplary process of the clothes clamping on the laundry treating apparatus.

Referring to FIG. 18A, the first securing body 6221 and the first clamp body 6211 may be separated from each other. Even the second securing body 6222 and the second clamp body 6221 may be separated from each other. Also, the compression unit 6, the support body 41 and the partition unit 66 may be also separated from each other.

Referring to FIG. 18B, the first and second parts C1 and C2 of the clothes may be inserted in the through slits provided in the second clamp body 6221 and the second securing body 6221 to locate the first part C1 between the partition unit 66 and the compression unit 6 and locate the second part C2 between the partition unit 66 and the support body 41.

After that, free ends of the first and second parts C1 and C2 may be overlapped and pulled tight. Hence, the clothes may be secured to the first clamp body 6211 and the second securing body 6221 in a state of being tightened.

Referring to FIG. 18C, the first clamp portion 91, the second clamp portion 92 and the partition plate 63 may be rotated towards the support body 41. At this time, the support body 41 and the partition plate 63 may be coupled to each other not to be separated from each other.

Referring to FIG. 18D, the compression unit 6 may be rotated towards the support body 41 to press the partition plate 63. After that, the compression unit 6 and the support body 41 may be coupled to each other to prevent the free separation between them.

Accordingly, both of the first and second parts C1 and C2 of the clothes may be pressed.

At this time, when heat and steam are supplied from the second heating unit 64, wrinkles may be removed from the first and second parts C1 and C2 and a crease may be put in them.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

What is claimed is:

1. A laundry treating apparatus comprising:

a cabinet defining an accommodation space for receiving clothes;

a door rotatably coupled to the cabinet, and configured to open and close the accommodation space;

a support body disposed to an inner surface of the door;

a compression body rotatably coupled to the inner surface of the door or the support body, and configured to press clothes with the support body; and a heating unit provided on at least one of the support body and the compression body, and configured to generate heat and supply the heat to the clothes disposed between the support body and the compression body, the heating unit being provided on a left side and a right side of the at least one of the support body and the compression body, respectively, wherein the compression body includes:

a compression body groove provided along a height direction of the compression body;

a first body provided on the left side of the compression body groove and extended along the height direction of the compression body; and a second body provided on the right side of the compression body groove and extended along the height direction of the compression body.

2. The laundry treating apparatus of claim 1, wherein the heating unit includes a heat source configured to generate the heat when a current is supplied from a power source.

3. The laundry treating apparatus of claim 2, wherein the heat source is provided as a wire.

4. The laundry treating apparatus of claim 3, wherein the wire extends along a height direction of the door.

5. The laundry treating apparatus of claim 2, wherein the heat source includes:

a first heat source provided on the first body; and a second heat source provided on the second body.

6. The laundry treating apparatus of claim 5, wherein the heating unit further includes:

a first body wire groove concavely formed on the first body, and configured to accommodate the first heat source;

a second body wire groove concavely formed on the second body, and configured to accommodate the second heat source;

a first heat plate fixed to the first body wire groove, and configured to cover the first heat source; and a second heat plate fixed to the second body wire groove, and configured to cover the second heat source.

7. The laundry treating apparatus of claim 2, wherein the compression body further includes a body through hole formed through the compression body groove, wherein the heating unit further includes a heat plate covering the heat source, and wherein the heat plate includes a heat plate groove disposed in the compression body groove and a through hole communicated with the body through hole.

8. The laundry treating apparatus of claim 2, wherein at least some area of the support body is formed of a conductive material.

9. The laundry treating apparatus of claim 8, wherein the heat source is fixed to a rear surface of the support body.

10. The laundry treating apparatus of claim 8, wherein the support body includes:

a fixing unit fixed to the inner surface of the door;

a first support surface extended vertically on a left side of the fixing unit and spaced apart from the inner surface of the door; and a second support surface extended vertically on a right side of the fixing unit and spaced apart from the inner surface of the door.

11. The laundry treating apparatus of claim 2, further comprising a moisture supply unit provided in at least one of the cabinet, the door, the support body and the compression body, and configured to supply steam to the support body or the compression body.

12. The laundry treating apparatus of claim 11, wherein the moisture supply unit includes:

a water tank provided in at least one of the support body and the compression body, and configured to hold water; and a heater configured to generate steam by heating water held in the water tank.

13. The laundry treating apparatus of claim 12, wherein the compression body further including an accommodation portion provided in the lower side of the compression body, and configured to accommodate the water tank.

* * * * *